US007022446B2

(12) United States Patent
Yoshimura et al.

(10) Patent No.: US 7,022,446 B2
(45) **Date of Patent: *Apr. 4, 2006**

(54) ELECTROPHOTOGRAPHIC PHOTOSENSITIVE MEMBER, PROCESS CARTRIDGE AND ELECTROPHOTOGRAPHIC APPARATUS

(76) Inventors: Kimihiro Yoshimura, Canon Kabushiki Kaisha 3-30-2, Shimomaruko, Ohta-ku, Tokyo (JP); Yosuke Morikawa, Canon Kabushiki Kaisha 3-30-2, Shimomaruko, Ohta-ku, Tokyo (JP); Tatsuya Ikezue, Canon Kabushiki Kaisha 3-30-2, Shimomaruko, Ohta-ku, Tokyo (JP); Kouichi Nakata, Canon Kabushiki Kaisha, 3-30-2, Shimomaruko, Ohta-ku, Tokyo (JP); Daisuke Tanaka, Canon Kabushiki Kaisha 3-30-2, Shimomaruko, Ohta-ku, Tokyo (JP)

( * ) Notice: Subject to any disclaimer, the term of this patent is extended or adjusted under 35 U.S.C. 154(b) by 113 days.

This patent is subject to a terminal disclaimer.

(21) Appl. No.: 10/616,944

(22) Filed: Jul. 11, 2003

(65) Prior Publication Data

US 2004/0023139 A1 Feb. 5, 2004

(30) Foreign Application Priority Data

Jul. 15, 2002 (JP) ..... 2002/205788

(51) Int. Cl.
*G03G 5/047* (2006.01)
*G03G 5/147* (2006.01)

(52) U.S. Cl. ..... 430/59.6; 430/66; 430/96

(58) Field of Classification Search ..... 430/59.6, 430/96, 66

See application file for complete search history.

(56) References Cited

U.S. PATENT DOCUMENTS

| | | | | |
|---|---|---|---|---|
| 3,396,016 | A | 8/1968 | Olsen | 96/1.8 |
| 4,595,602 | A | 6/1986 | Schank | 427/76 |
| 5,629,117 | A | 5/1997 | Katsukawa et al. | 430/83 |
| 5,876,890 | A | 3/1999 | Kitamura et al. | 430/59 |
| 5,994,011 | A | 11/1999 | Kashimura | 430/58 |
| 6,555,279 | B1 * | 4/2003 | Nakata et al. | 430/66 |

FOREIGN PATENT DOCUMENTS

| | | |
|---|---|---|
| EP | 0 589 309 | 3/1994 |
| EP | 0997777 | 5/2000 |
| JP | 61-72257 | 4/1986 |
| JP | 62-14657 | 1/1987 |
| JP | 6-282067 | 10/1994 |
| JP | 06-308756 | 11/1994 |
| JP | 6-312947 | 11/1994 |
| JP | 10-228126 | 8/1998 |

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member having a surface layer containing at least one of a charge-transporting material and conductive particles and a polymer obtained by polymerizing at least one selected from the group consisting of a polyhydroxymethylbisphenol monomer having a specific structure, a polyhydroxymethylbisphenol oligomer having a specific structure, a polyhydroxymethyltrisphenol monomer having a specific structure and a polyhydroxymethyltrisphenol oligomer having a specific structure; and a process cartridge and an electrophotographic apparatus which have the electrophotographic photosensitive member.

17 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

Electrophotographic photosensitive members used in electrophotographic apparatus are required to have a stated sensitivity, electrical properties and optical properties which have been adapted to any electrophotographic process. In particular, the surface layers of electrophotographic photosensitive members are required to have durability to electrical and mechanical external forces because such forces are directly applied thereto through charging, development by toner, transfer to transfer materials, cleaning to remove residual toner, and so forth. Stated specifically, they are required to have durability against scratches and wear which are due to friction and, especially when a charging method involving discharge, durability against chemical deterioration due to ozone, nitrogen oxides and the like which may remarkably be generated in an environment of high humidity. At the time of the cleaning to remove residual toner, they are further required to have properties such as surface slip properties, releasability and stain resistance because there are problems of the adhesion of toner to electrophotographic photosensitive member surface and the blade turn-over when blade cleaning is performed.

To meet such requirements, it is proposed to use, as materials for the surface layers of electrophotographic photosensitive members, resins having good releasability and slip properties as typified by fluorine-atom-containing resins and resin materials having high hardness as typified by silicone resins, urethane resins and unsaturated ester materials.

However, any materials that may satisfy such various properties have not still been discovered. For example, the fluorine-atom-containing resins have a low hardness when used alone, and it is difficult for them to keep scratches from occurring. In addition, the fluorine-atom-containing resins are slightly soluble in solvents commonly used, and it is not easy for them to form films.

Japanese Patent Application Laid-open No. 61-072257 discloses an example in which a high-hardness material such as a curable silicone resin that utilizes the high reactivity of an alkoxysilane is used in an electrophotographic photosensitive member. Such a high-hardness material, however, has not been satisfactory in respect of slip properties, electrical properties in an environment of high humidity, and releasability. In addition, such a high-hardness material has a high reactivity with hydroxyl groups, and hence has restrictions on solvents when photosensitive layers are formed by coating. The curing reaction may also slowly proceed under the influence of water content, and hence coating fluids therefor may have a poor stability. Thus, there has been a problem also in respect of the productivity of electrophotographic photosensitive members.

A material which forms cured films utilizing the cleavage of unsaturated bonds as in prepolymers of diallyl phthalate resins, disclosed in Japanese Patent Application Laid-open No. 62-014657, is also commonly radically polymerizable.

Coating fluids making use of this material are relatively stable to water content. However, only cured products having unstable electric properties in respect of insulation resistance and the like are obtainable because of, e.g., any faulty curing at film surface that is due to a polymerization inhibitory effect caused by oxygen in the air and any reaction to cut carbon-carbon bonds that is due to irradiation by light when a photoinitiator is used. Hence, this has brought about a problem that the transfer efficiency may lower because of a rise of surface energy of the electrophotographic photosensitive member or that images may blur as a result of moisture absorption.

Meanwhile, as materials used in the surface layers of electrophotographic photosensitive members, not only external properties such as the above hardness, rubbing-friction resistance and slip properties, but also internal electrical properties are required that do not make the movement of electric charges stagnate also in the interior of the surface layer. Where the surface layer of an electrophotographic photosensitive member has no function to move electric charges, the electric charges may accumulate in the interior of the photosensitive layer, and the repetition of the electrophotographic process of charging and exposure causes a rise of residual potential, resulting in a lowering of the quality level of images reproduced.

To solve this problem, a method is proposed in which a charge-transporting material is incorporated in the surface layer. However, when, e.g., a charge-transporting material is added to an alkoxysilane to effect curing, the siloxane component of the alkoxysilane has poor compatibility with the charge-transporting material in many cases. Also, when a charge-transporting material is incorporated in a resin containing a unit having a high polarity as in urethane resin, the mobility of electric charges in virtue of the charge-transporting material may lower, and any satisfactory electrophotographic performance can not be obtained. These are the actual circumstances.

Moreover, some thermosetting resins are not sufficiently curable when only subjected to heat treatment, and require addition of curing catalysts such as curing accelerators and polymerization initiators. Such materials are seen in variety. However, where such curing catalysts have remained in cured films, there is a possibility of causing a difficulty such that they inhibit the movement of electric charges even in a very small quantity or that the cured films have a low electrical resistance.

Coating fluids to which such curing catalysts have been added also have a tendency that the reaction may gradually proceed even at normal temperature, resulting in a poor coating fluid stability, and also causing a difficulty that it is difficult to produce and store coating fluids in a large quantity.

Japanese Patent Application Laid-open No. 10-228126 and so forth also disclose examples in which a charge-transporting material having a hydroxyphenyl group or a hydroxyalkyl group is incorporated in the surface layer of an electrophotographic photosensitive member. However, in such an electrophotographic photosensitive member as well, it is the actual circumstances that the requirements for higher durability, higher productivity and higher image quality in recent years have not been met and all the respects of mechanical strength, residual potential, productivity and so forth have not been made sufficiently satisfactory.

SUMMARY OF THE INVENTION

An object of the present invention is to provide an electrophotographic photosensitive member having a cure type surface layer which has a superior wear resistance and has a hardness high enough not to cause any scratches, without adding any curing catalyst, and besides does not cause any deterioration of the charge transport performance the electrophotographic photosensitive member has originally.

Another object of the present invention is to provide an electrophotographic photosensitive member having a surface layer which can be formed by coating in a high productivity.

Still another object of the present invention is to provide a process cartridge and an electrophotographic apparatus which have the above electrophotographic photosensitive member.

More specifically, the present invention is an electrophotographic photosensitive member comprising a support and provided thereon a photosensitive layer, wherein;

the electrophotographic photosensitive member has a surface layer containing:

at least one of a charge-transporting material and conductive particles; and a polymer obtained by polymerizing at least one selected from the group consisting of a polyhydroxymethylbisphenol monomer having 2 or 3 benzene rings and 2 to 4 hydroxymethyl groups; a polyhydroxymethylbisphenol oligomer having a structure in which a bisphenol monomer having 2 or 3 benzene rings has been condensed, and having 2 to 4 hydroxymethyl groups; a polyhydroxymethyltrisphenol monomer having 3 or 4 benzene rings and 2 to 6 hydroxymethyl groups; and a polyhydroxymethyltrisphenol oligomer having a structure in which a trisphenol monomer having 3 or 4 benzene rings has been condensed, and having 2 to 6 hydroxymethyl groups.

The present invention is also a process cartridge and an electrophotographic apparatus which have the above electrophotographic photosensitive member.

DESCRIPTION OF THE PREFERRED EMBODIMENTS

The present invention is described below in detail.

The photosensitive layer of the electrophotographic photosensitive member of the present invention may be either of a single-layer type photosensitive layer, in which a charge-generating material and a charge-transporting material are contained in a single layer, and a multi-layer type photosensitive layer, in which a charge generation layer containing a charge-generating material and a charge transport layer containing a charge-transporting material are superposed.

FIGS. 1A to 1D show examples of the layer construction of the electrophotographic photosensitive member of the present invention.

Figure 1A:
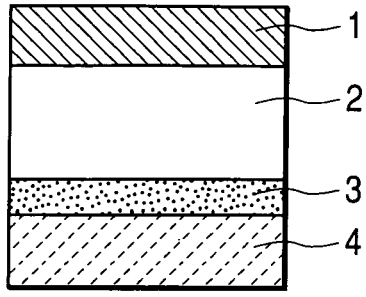
FIGS. 1A, 1B, 1C and 1D are sectional views showing examples of the layer construction of the electrophotographic photosensitive member of the present invention.

The electrophotographic photosensitive member having the layer construction shown in FIG. 1A comprises a support 4 and provided thereon a charge generation layer 3 and a charge transport layer 2 in this order, and further provided thereon as a surface layer a layer 1 containing i) at least one of a charge-transporting material and conductive particles and ii) a polymer obtained by polymerizing a polyhydroxymethylbisphenol monomer having 2 or 3 benzene rings and 2 to 4 hydroxymethyl groups (also simply "polyhydroxymethylbisphenol monomer" in the present invention); a polyhydroxymethylbisphenol oligomer having a structure in which a bisphenol monomer having 2 or 3 benzene rings has been condensed, and having 2 to 4 hydroxymethyl groups (also simply "polyhydroxymethylbisphenol oligomer" in the present invention); a polyhydroxymethyltrisphenol monomer having 3 or 4 benzene rings and 2 to 6 hydroxymethyl groups (also simply "polyhydroxymethyltrisphenol monomer" in the present invention; and/or a polyhydroxymethyltrisphenol oligomer having a structure in which a trisphenol monomer having 3 or 4 benzene rings has been condensed, and having 2 to 6 hydroxymethyl groups (also simply "polyhydroxymethyltrisphenol oligomer" in the present invention).

Figure 1B:
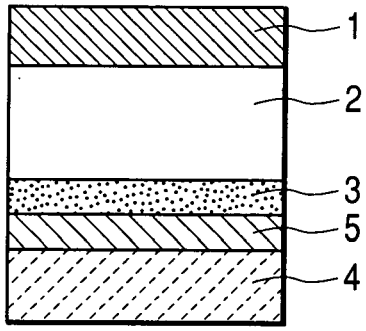
Figure 1C:
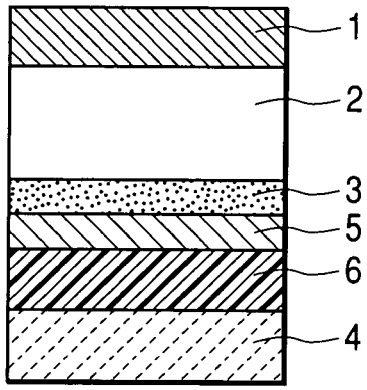

As also shown in FIGS. 1B and 1C, an intermediate layer (a barrier layer or an adhesion layer) 5 having the function as a barrier or the function of adhesion or a conductive layer 6 intended for the prevention of interference fringes may be provided between a support 4 and a charge generation layer 3.

Figure 1D:
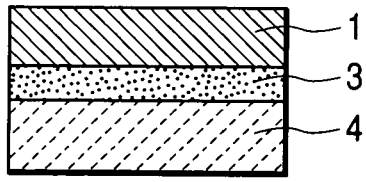

The electrophotographic photosensitive member having the layer construction shown in FIG. 1D comprises a support 4 and provided thereon a charge generation layer 3 and further directly provided thereon as a surface layer a layer 1 containing i) at least one of a charge-transporting material and conductive particles and ii) a polymer obtained by polymerizing a polyhydroxymethylbisphenol monomer, a polyhydroxymethylbisphenol oligomer, a polyhydroxymethyltrisphenol monomer and/or a polyhydroxymethyltrisphenol oligomer.

Besides the foregoing, the electrophotographic photosensitive member may have any other layer construction as long as its surface layer contains i) at least one of a charge-transporting material and conductive particles and ii) a polymer obtained by polymerizing a polyhydroxymethylbisphenol monomer, a polyhydroxymethylbisphenol oligomer, a polyhydroxymethyltrisphenol monomer and/or a polyhydroxymethyltrisphenol oligomer.

As the support of the electrophotographic photosensitive member of the present invention, it may be one having conductivity. For example, usable are supports made of a metal such as aluminum, aluminum alloy or stainless steel. Also usable are the above supports made of a metal, or supports made of a plastic, and having layers film-formed by vacuum deposition of aluminum, aluminum alloy, indium oxide-tin oxide alloy or the like. Still also usable are supports comprising plastic or paper impregnated with conductive fine particles (e.g., carbon black, tin oxide particles, titanium oxide particles or silver particles) together with a suitable binder resin, and plastics containing a conductive binder resin.

As mentioned above, the conductive layer may be provided on the support for the purpose of preventing interference fringes caused by scattering of laser light or covering any scratches of the support surface. The conductive layer may be formed by coating the support with a dispersion prepared by dispersing conductive particles such as carbon black or metal particles in a binder resin. The conductive layer may preferably be in a layer thickness of from 5 μm to 40 μm, and particularly more preferably from 10 μm to 30 μm.

As also mentioned above, the intermediate layer having the function as a barrier and the function of adhesion may be provided between the support or conductive layer and the photosensitive layer (charge generation layer and charge transport layer). The intermediate layer is formed for the purposes of, e.g., improving the adhesion of the photosensitive layer, improving coating performance, improving the injection of electric charges from the support and protecting the photosensitive layer from any electrical breakdown. The intermediate layer may be formed using a material such as casein, polyvinyl alcohol, ethyl cellulose, an ethylene-acrylic acid copolymer, polyamide, modified polyamide, polyurethane, gelatin or aluminum oxide. The intermediate layer may preferably be in a layer thickness of 5 μm or less, and particularly more preferably from 0.1 μm to 3 μm.

The charge-generating material used in the electrophotographic photosensitive member of the present invention may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, styryl dyes, cadmium sulfide, and zinc oxide.

In the case when the photosensitive layer is the multilayer type photosensitive layer, the binder resin used to form the charge generation layer may include polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. Any of these may be used alone or in the form of a mixture or copolymer of two or more types.

As a solvent used for a charge generation layer coating dispersion, it may be selected taking account of the binder resin to be used and the solubility or dispersion stability of the charge-generating material. As an organic solvent, usable are alcohols, sulfoxides, ketones, ethers, esters, aliphatic halogenated hydrocarbons or aromatic compounds.

The charge generation layer may be formed by coating a charge generation layer coating dispersion obtained by dispersing the charge-generating material in the binder resin together with the solvent, followed by drying. As a method for dispersion, a method making use of a homogenizer, an ultrasonic dispersion machine, a ball mill, a sand mill, an attritor or a roll mill is available. The charge-generating material and the binder resin may preferably be in a proportion ranging from 1:0.3 to 1:4. The charge generation layer may also preferably be in a layer thickness of 5 μm or less, and particularly more preferably from 0.01 μm to 1 μm.

To the charge generation layer, a sensitizer, an antioxidant, an ultraviolet absorber and a plasticizer which may be of various types may also optionally be added.

The charge-transporting material used in the electrophotographic photosensitive member of the present invention may include triarylamine compounds, hydrazone compounds, styryl compounds, stilbene compounds, pyrazoline compounds, oxazole compounds, thiazole compounds, and triarylmethane compounds.

As a binder resin used to form a charge transport layer which is not the surface layer of the electrophotographic photosensitive member as in the case of the charge transport layer 2 shown in FIGS. 1A, 1B and 1C, it may include, e.g., acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate, polystyrene, a styrene-acrylonitrile copolymer, polycarbonate resins, polyarylate resins and diallyl phthalate resins are preferred.

The charge transport layer may be formed by coating a charge transport layer coating solution prepared by dissolving the charge-transporting material and binder resin in a solvent, followed by drying. The charge-transporting material and the binder resin may preferably be in a proportion of from about 2:1 to 1:2 in weight ratio. As the solvent, usable are ketones such as acetone and methyl ethyl ketone, esters such as methyl acetate and ethyl acetate, aromatic hydrocarbons such as toluene and xylene, and hydrocarbons substituted with a halogen atom, such as chlorobenzene, chloroform and carbon tetrachloride. When this charge transport layer coating solution is coated, coating methods as exemplified by dip coating, spray coating and spinner coating may be used. When the wet coating formed is dried, the drying may preferably be carried out at a temperature ranging from 10° C. to 200° C., and particularly more preferably from 20° C. to 150° C. The drying may also be carried out for a time of preferably from 5 minutes to 5 hours, and particularly more preferably from 10 minutes to 2 hours. The drying may be carried out under air drying or drying at rest.

The charge transport layer which is not the surface layer of the electrophotographic photosensitive member may preferably be in a layer thickness of from 5 μm to 40 μm, and particularly more preferably from 7 μm to 30 μm.

To the charge transport layer, an antioxidant, an ultraviolet absorber, a plasticizer and so forth may also optionally be added.

As described above, the surface layer of the electrophotographic photosensitive member, provided on the photosensitive layer (e.g., on the charge transport layer), or the surface layer of the electrophotographic photosensitive member, provided directly on the charge generation layer, contains the polymer obtained by polymerizing a polyhydroxymethylbisphenol monomer, a polyhydroxymethylbisphenol oligomer, a polyhydroxymethyltrisphenol monomer and/or a polyhydroxymethyltrisphenol oligomer.

In the surface layer of the electrophotographic photosensitive member, the polymer obtained by polymerizing a polyhydroxymethylbisphenol monomer, a polyhydroxymethylbisphenol oligomer, a polyhydroxymethyltrisphenol monomer and/or a polyhydroxymethyltrisphenol oligomer may preferably be contained in an amount of from 10 to 80% by weight, and particularly more preferably from 30 to 60% by weight, based on the total weight of the surface layer.

The polyhydroxymethylbisphenol monomer, the polyhydroxymethylbisphenol oligomer, the polyhydroxymethyltrisphenol monomer and the polyhydroxymethyltrisphenol oligomer which are used in the present invention form, upon heat treatment, ether linkages by condensation reaction of hydroxymethyl groups with each other, or, as the condensation reaction further proceeds, form methylene linkages, or form methylene linkages by condensation reaction of hydroxymethyl groups with hydrogen atoms at the ortho-or para-position of hydroxy groups in the hydroxyphenyl groups. These condensation reactions take place between various molecules, so that three-dimensional cured films with a high crosslink density can be obtained. These condensation reactions are reactions which proceed sufficiently even in a system to which the charge-transporting material has been added, without being inhibited by the water content or oxygen in the air.

There is also a characteristic feature that the cross-linking reaction by the heat treatment of any of the polyhydroxymethylbisphenol monomer, polyhydroxymethylbisphenol oligomer, polyhydroxymethyltrisphenol monomer and polyhydroxymethyltrisphenol oligomer used in the present invention does not require any addition of curing catalysts which are commonly used when thermosetting resins are cured. Hence, the use of the polyhydroxymethylbisphenol monomer, polyhydroxymethylbisphenol oligomer, polyhydroxymethyltrisphenol monomer and/or polyhydroxymethyltrisphenol oligomer in the surface layer of the electrophotographic photosensitive member also does not cause the problems of a rise of residual potential or a lowering of resistance of the surface layer which are caused by residual curing catalysts.

Since the polyhydroxymethylbisphenol monomer, polyhydroxymethylbisphenol oligomer, polyhydroxymethyltrisphenol monomer and polyhydroxymethyltrisphenol oligomer used in the present invention do not require any addition of curing catalysts and also their hydroxymethyl groups are sufficiently stable to water content as being different from isocyanates or silicone resins, a coating solution for forming the surface layer of the electrophotographic photosensitive member also has a good stability.

The polyhydroxymethylbisphenol monomer used in the present invention may preferably be a polyhydroxymethylbisphenol monomer having 2 or 3 benzene rings bonded or linked through a single bond, a carbonyl group, an ether group, a thioether group or a —$CR^{01}R^{02}$-group ($R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded). In particular, it may more preferably be a polyhydroxymethylbisphenol monomer having a structure represented by the following Formula (1):

(1)

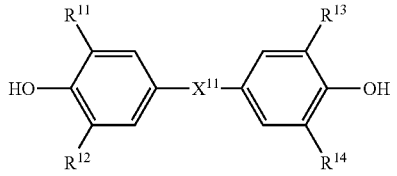

In Formula (1), $X^{11}$ represents a single bond, a carbonyl group, an ether group, a thioether group or a —$CR^{01}R^{02}$-group ($R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded). $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group.

The polyhydroxymethylbisphenol oligomer used in the present invention may preferably be a polyhydroxymethylbisphenol oligomer having a structure in which a bisphenol monomer having 2 or 3 benzene rings has been condensed which are bonded or linked through a single bond, a carbonyl group, an ether group, a thioether group or a —$CR^{01}R^{02}$-group ($R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded). In particular, it may more preferably be a polyhydroxymethylbisphenol oligomer having a structure in which a bisphenol monomer having a structure represented by the following Formula (2) has been condensed through a methylene group:

(2)

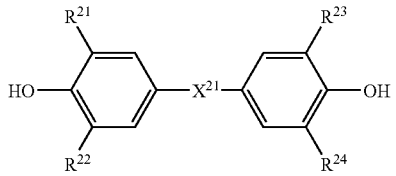

In Formula (2), $X^{21}$ represents a single bond, a carbonyl group, an ether group, a thioether group or a —$CR^{01}R^{02}$-group ($R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded). $R^{21}$ to $R^{24}$ each independently represent a hydrogen atom, a halogen atom, a substituted or unsubstituted alkyl group having 1 to 4 carbon atoms, a substituted or unsubstituted cycloalkyl group having 3 to 6 carbon atoms, or a substituted or unsubstituted alkoxyl group having 1 to 4 carbon atoms.

A case in which the $X^{11}$ in Formula (1) or the $X^{21}$ in Formula (2) is a divalent group having 3 or more carbon atoms is also preferable because the polyhydroxymethylbisphenol monomer and the polyhydroxymethylbisphenol oligomer are improved in solubility to enable preparation of coating solutions having superior productivity.

A case in which the $X^{11}$ in Formula (1) or the $X^{21}$ in Formula (2) is a divalent group having 5 or more carbon atoms and having a cyclic structure is also preferable because the polyhydroxymethylbisphenol monomer and the polyhydroxymethylbisphenol oligomer are improved in solubility and also because the surface layer of the electrophotographic photosensitive member, containing the polymer of polyhydroxymethylbisphenol monomer or polyhydroxymethylbisphenol oligomer is much more improved in strength.

Where a charge-transporting material is incorporated in the surface layer of the electrophotographic photosensitive member, a case in which the $X^{11}$ in Formula (1) or the $X^{21}$ in Formula (2) is a divalent group having a benzene ring is also preferable because the polyhydroxymethylbisphenol monomer and the polyhydroxymethylbisphenol oligomer are improved in their compatibility with the charge-transporting material and further because the build-up of polarization of electrons that is attributable to an increase in aromatic units brings a much more improvement in the ability to transport electric charges in the surface layer of the electrophotographic photosensitive member.

A case in which the $X^{11}$ in Formula (1) or the $X^{21}$ in Formula (2) is an ether group, a thioether group or a di(trifluoromethyl)methylene group is also preferable because the surface layer of the electrophotographic photosensitive member, containing the polymer of polyhydroxymethylbisphenol monomer or polyhydroxymethylbisphenol oligomer is much more improved in strength in virture of the hetero atoms of those groups.

The polyhydroxymethyltrisphenol monomer used in the present invention may also preferably be a polyhydroxymethyltrisphenol monomer having a structure represented by the following Formula (3):

(3)

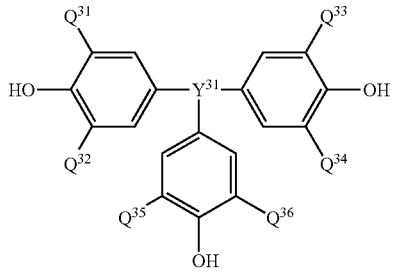

In Formula (3), $Q^{31}$ to $Q^{36}$ each independently represent a hydroxymethyl group, a hydrogen atom, a halogen atom, a substituted or unsubstituted alkyl group having 1 to 4 carbon atoms other than the hydroxymethyl group, a substituted or unsubstituted alkenyl group having 1 to 4 carbon atoms, or a substituted or unsubstituted alkoxyl group having 1 to 4 carbon atoms, provided that at least two of the $Q^{31}$ to $Q^{36}$ are each a hydroxymethyl group. $Y^{31}$ represents a trivalent group having a structure represented by the following Formula (31), a trivalent group having a structure represented by the following Formula (32) or a trivalent group having a structure represented by the following Formula (33):

(31)

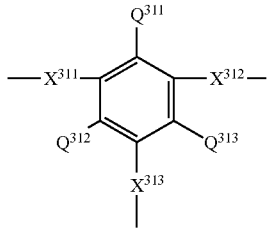

In Formula (31), $X^{311}$ to $X^{313}$ each independently represent a single bond, a carbonyl group, an ether group, a thioether group or a —$CR^{01}R^{02}$-group ($R^{01}$ and $R^{02}$ each independently represent a hydrogen atom or a substituted or unsubstituted alkyl group having 1 to 4 carbon atoms). $Q^{311}$ to $Q^{313}$ each independently represent a hydrogen atom or a substituted or unsubstituted alkyl group having 1 to 4 carbon atoms.

(32)

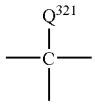

In Formula (32), $Q^{321}$ represents a hydrogen atom or a substituted or unsubstituted alkyl group having 1 to 4 carbon atoms.

(33)

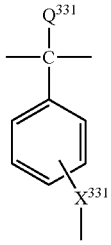

In Formula (33), $X^{331}$ represents a single bond, a carbonyl group, an ether group, a thioether group or a —$CR^{01}R^{02}$-group ($R^{01}$ and $R^{02}$ each independently represent a hydrogen atom or a substituted or unsubstituted alkyl group having 1 to 4 carbon atoms). $Q^{331}$ represents a hydrogen atom or a substituted or unsubstituted alkyl group having 1 to 4 carbon atoms.

The polyhydroxymethyltrisphenol oligomer used in the present invention may preferably be a polyhydroxymethyltrisphenol oligomer having a structure in which a trisphenol monomer having a structure represented by the following Formula (4) has been condensed through a methylene group:

(4)

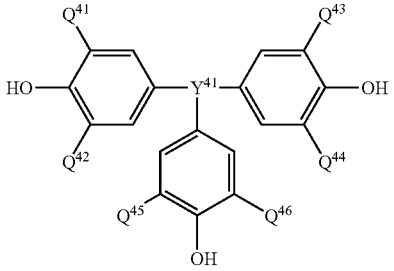

In Formula (4), $Q^{41}$ to $Q^{46}$ each independently represent a hydrogen atom, a halogen atom, a substituted or unsubstituted alkyl group having 1 to 4 carbon atoms, a substituted or unsubstituted alkenyl group having 1 to 4 carbon atoms, or a substituted or unsubstituted alkoxyl group having 1 to 4 carbon atoms. $Y^{41}$ represents a trivalent group having a structure represented by the following Formula (41), a trivalent group having a structure represented by the following Formula (42) or a trivalent group having a structure represented by the following Formula (43):

(41)

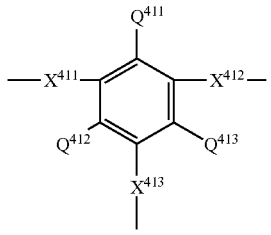

In Formula (41), $X^{411}$ to $X^{413}$ each independently represent a single bond, a carbonyl group, an ether group, a thioether group or a —$CR^{01}R^{02}$-group ($R^{01}$ and $R^{02}$ each independently represent a hydrogen atom or a substituted or unsubstituted alkyl group having 1 to 4 carbon atoms). $Q^{411}$ to $Q^{413}$ each independently represent a hydrogen atom or a substituted or unsubstituted alkyl group having 1 to 4 carbon atoms.

(42)

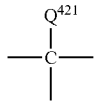

In Formula (42), $Q^{421}$ represents a hydrogen atom or a substituted or unsubstituted alkyl group having 1 to 4 carbon atoms.

(43)

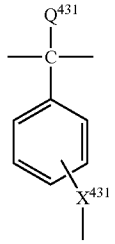

In Formula (43), $X^{431}$ represents a single bond, a carbonyl group, an ether group, a thioether group or a —$CR^{01}R^{02}$-group ($R^{01}$ and $R^{02}$ each independently represent a hydrogen atom or a substituted or unsubstituted alkyl group having 1 to 4 carbon atoms). $Q^{431}$ represents a hydrogen atom or a substituted or unsubstituted alkyl group having 1 to 4 carbon atoms.

A case in which at least one of the $X^{311}$ to $X^{313}$ in Formula (31), or the $X^{331}$ in Formula (33), or at least one of the $X^{411}$ to $X^{413}$ in Formula (41), or the $X^{431}$ in Formula (43) is a divalent group having 3 or more carbon atoms is also preferable because the polyhydroxymethyltrisphenol monomer and the polyhydroxymethyltrisphenol oligomer are improved in solubility to enable preparation of coating solutions having superior productivity.

A case in which at least one of the $X^{311}$ to $X^{313}$ in Formula (31), or the $X^{331}$ in Formula (33), or at least one of the $X^{411}$ to $X^{413}$ in Formula (41), or the $X^{431}$ in Formula (43) is an ether group or a thioether group is also preferable because the surface layer of the electrophotographic photosensitive member, containing the polymer of polyhydroxymethyltrisphenol monomer or polyhydroxymethyltrisphenol oligomer is much more improved in strength in virtue of the hetero atoms these groups have.

Where a charge-transporting material is incorporated in the surface layer of the electrophotographic photosensitive member, a case in which the $Y^{31}$ in Formula (3) is a trivalent group having the structure represented by Formula (31), or the $Y^{41}$ in Formula (4) is a trivalent group having the structure represented by Formula (41) is also preferable because the polyhydroxymethyltrisphenol monomer and the polyhydroxymethyltrisphenol oligomer are improved in their compatibility with the charge-transporting material and further because the build-up of polarization of electrons that is attributable to an increase in aromatic units brings a much more improvement in the ability to transport electric charges in the surface layer of the electrophotographic photosensitive member.

In the following, examples of the polyhydroxymethylbisphenol monomer used in the present invention and those of the bisphenol monomer (bisphenol monomer having 2 or 3 benzene rings) used when the polyhydroxymethylbisphenol oligomer used in the present invention is obtained by condensation are shown together.

In the following formulas (B-1) to (B-55), $R^{B1}$ to $R^{B4}$ each independently represent a hydroxymethyl group or a hydrogen atom, provided that, in the case of the polyhydroxymethylbisphenol monomer, two to four of $R^{B1}$ to $R^{B4}$ are hydroxymethyl groups. Incidentally, among the following formulas (B-1) to (B-55), in the case of formulas in which at least one of $R^{B1}$ to $R^{B4}$ lacks, two to three of those which do not lack (i.e., the remainder) are hydroxymethyl groups.

In the case of the bisphenol monomer used when the polyhydroxymethylbisphenol oligomer is obtained by condensation, any of the $R^{B1}$ to $R^{B4}$ may be a hydrogen atom or may be a hydroxymethyl group, but, as described above, it is essential that the polyhydroxymethylbisphenol oligomer having the structure in which the bisphenol monomer has been condensed has 2 to 4 hydroxymethyl groups.

(B-1)

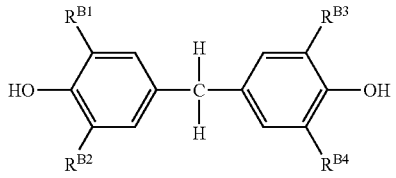

(B-2)

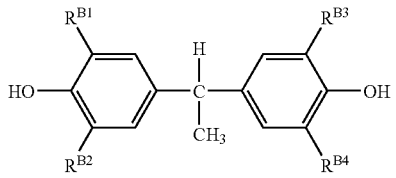

(B-3)

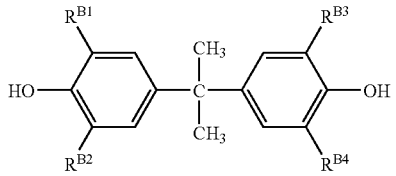

-continued
(B-4)
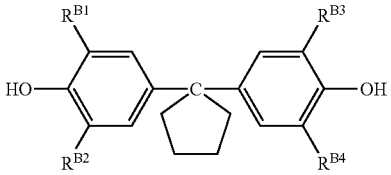
(B-5)
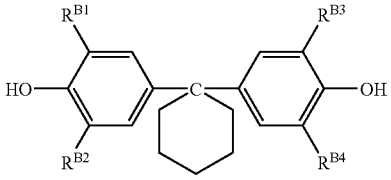
(B-6)
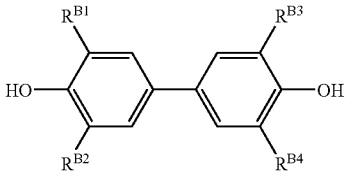
(B-7)
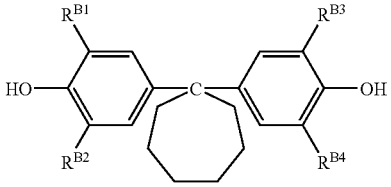
(B-8)
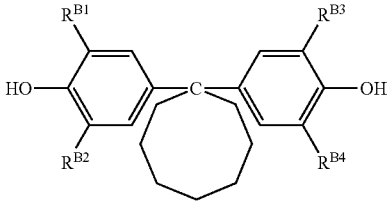
(B-9)
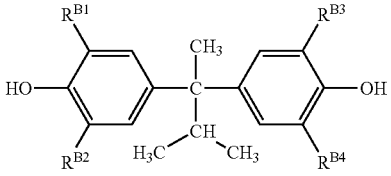
(B-10)
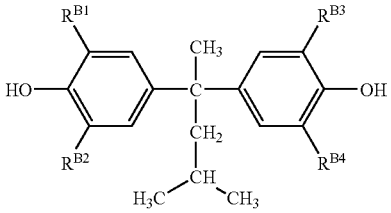
(B-11)
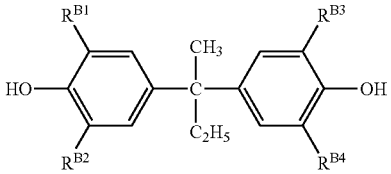
-continued
(B-12)
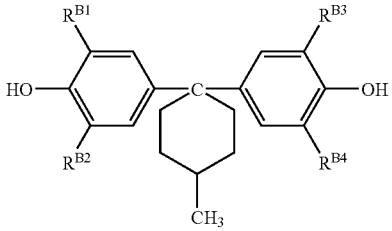
(B-13)
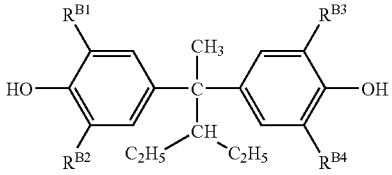
(B-14)
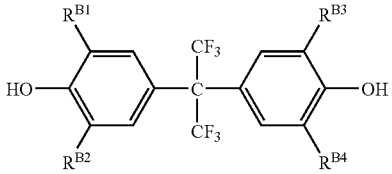
(B-15)
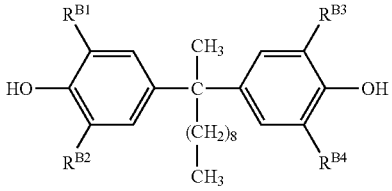
(B-16)
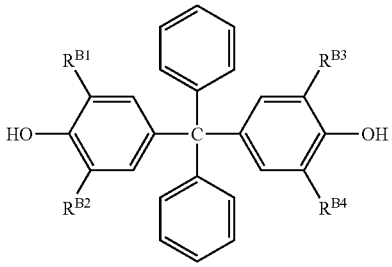
(B-17)
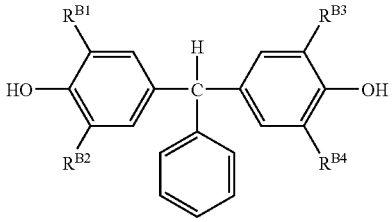
(B-18)
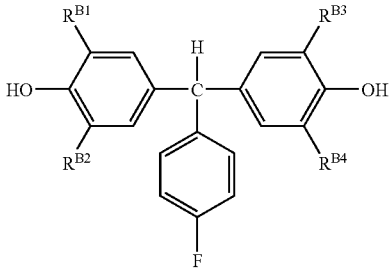

-continued
(B-19)
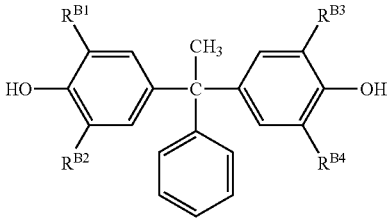
(B-20)
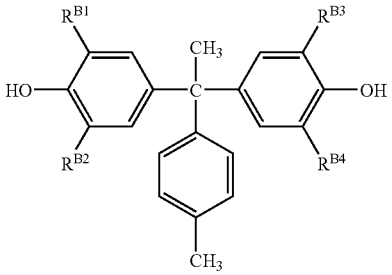
(B-21)
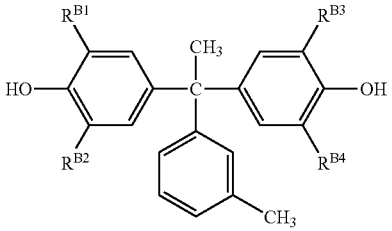
(B-22)
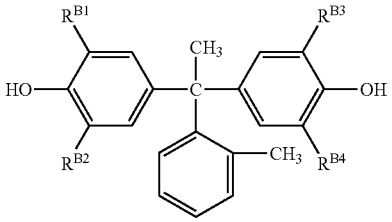
(B-23)
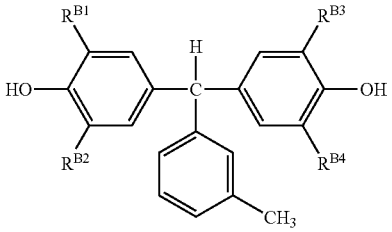
(B-24)
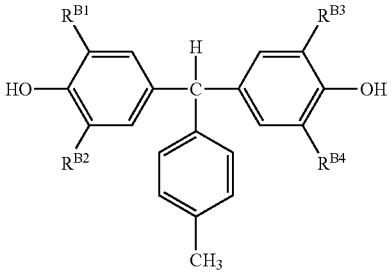
-continued
(B-25)
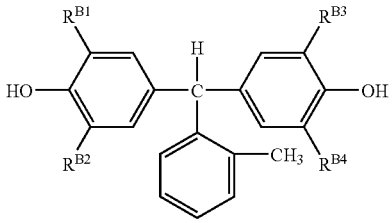
(B-26)
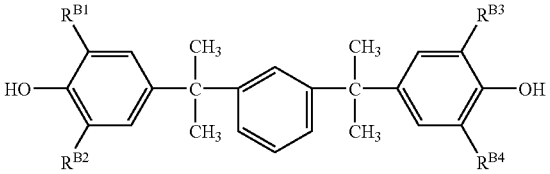
(B-27)
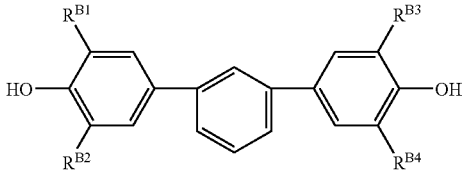
(B-28)
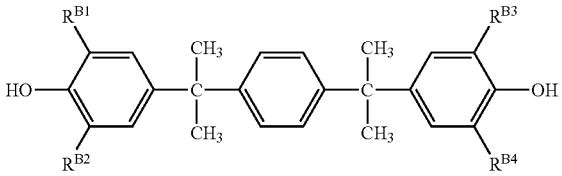
(B-29)
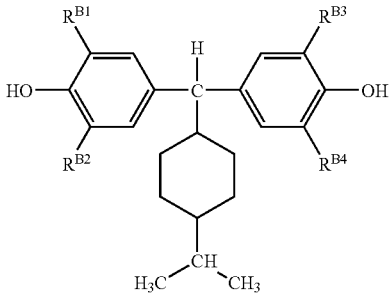
(B-30)
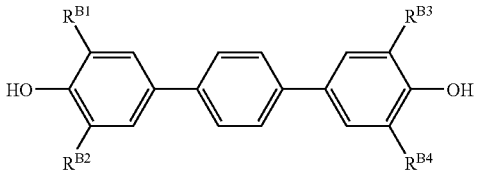
(B-31)
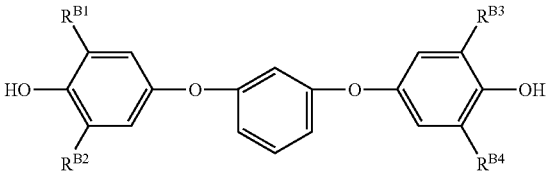

-continued
(B-32)
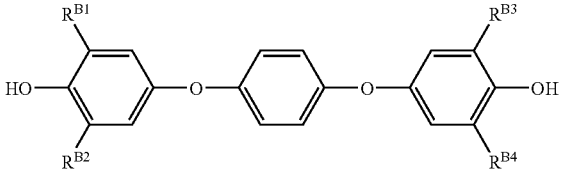
(B-33)
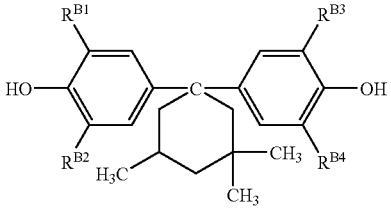
(B-34)
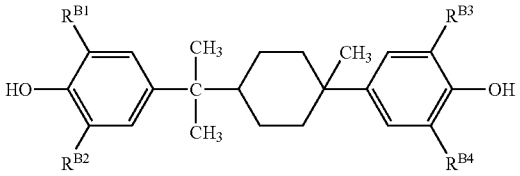
(B-35)
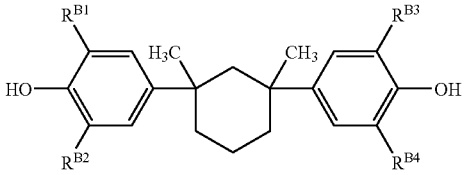
(B-36)
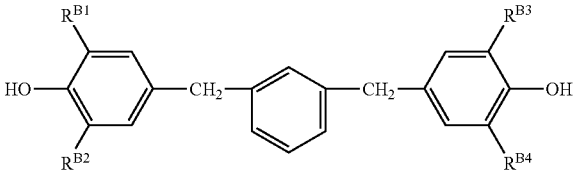
(B-37)
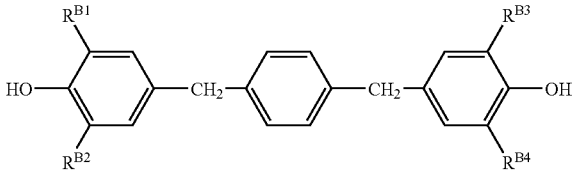
(B-38)
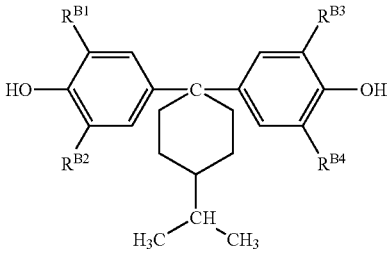
-continued
(B-39)
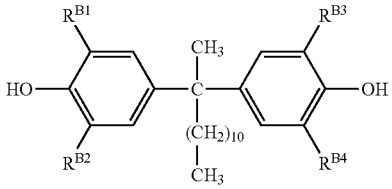
(B-40)
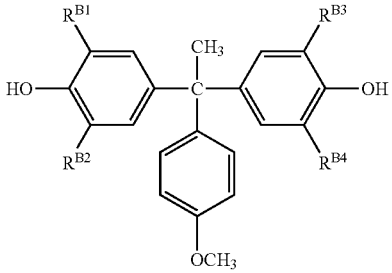
(B-41)
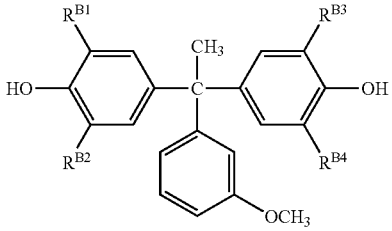
(B-42)
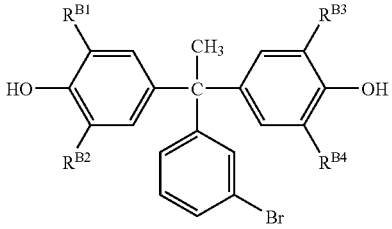
(B-43)
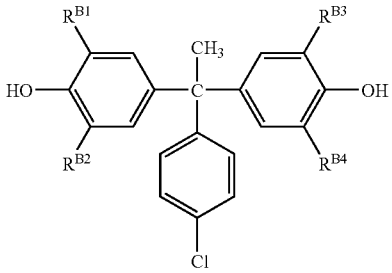
(B-44)
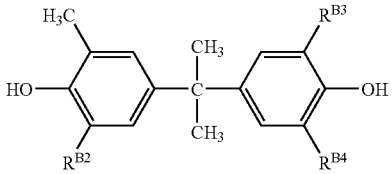
(B-45)
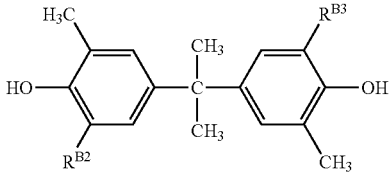

-continued (B-46)

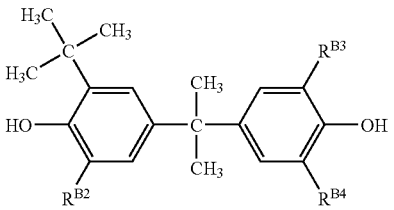

(B-47)

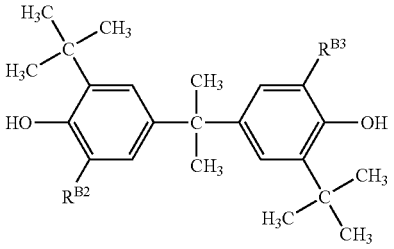

(B-48)

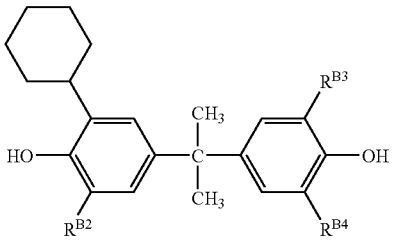

(B-49)

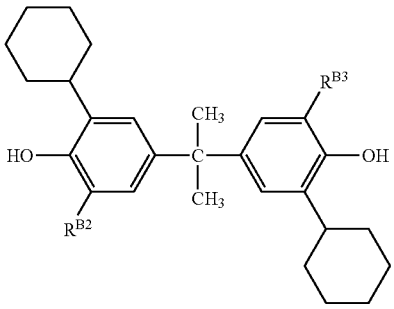

(B-50)

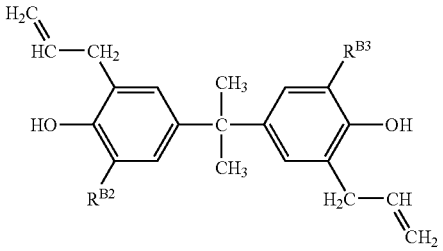

(B-51)

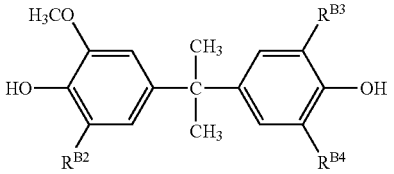

-continued (B-52)

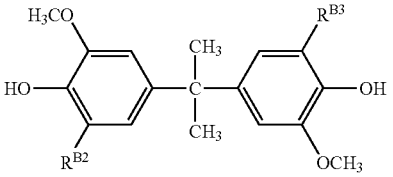

(B-53)

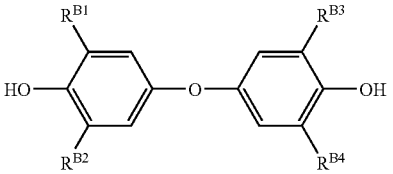

(B-54)

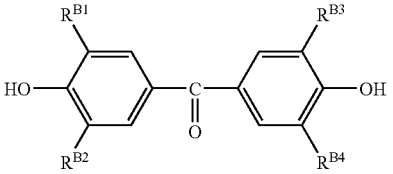

(B-55)

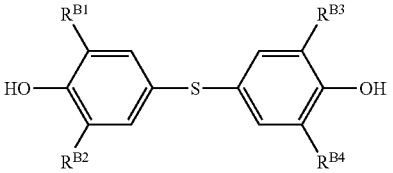

The polyhydroxymethylbisphenol monomer and polyhydroxymethylbisphenol oligomer used in the present invention are disclosed in, e.g., Japanese Patent Applications Laid-open No. 6-282067 and No. 6-312947.

In the following, examples of the polyhydroxymethyltrisphenol monomer used in the present invention and those of the trisphenol monomer (trisphenol monomer having 2 or 3 benzene rings) used when the polyhydroxymethyltrisphenol oligomer used in the present invention is obtained by condensation are shown together.

In the following formulas (T-1) to (T-25), $R^{T1}$ to $R^{T6}$ each independently represent a hydroxymethyl group or a hydrogen atom, provided that, in the case of the polyhydroxymethyltrisphenol monomer, two to six of $R^{T1}$ to $R^{T6}$ are hydroxymethyl groups. Incidentally, among the following formulas (T-1) to (T-25), in the case of formulas in which at least one of $R^{T1}$ to $R^{T6}$ lacks, two to five of those which do not lack (i.e., the remainder) are hydroxymethyl groups.

In the case of the trisphenol monomer used when the polyhydroxymethyltrisphenol oligomer is obtained by condensation, any of the $R^{T1}$ to $R^{T6}$ may be a hydrogen atom or may be a hydroxymethyl group, but, as described previously, it is essential that the polyhydroxymethyltrisphenol oligomer having the structure in which the trisphenol monomer has been condensed has 2 to 6 hydroxymethyl groups.

(T-1)
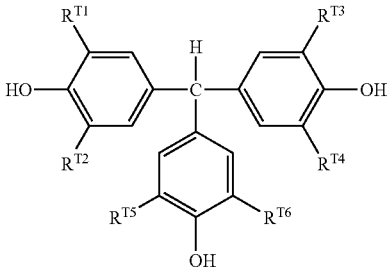
(T-2)
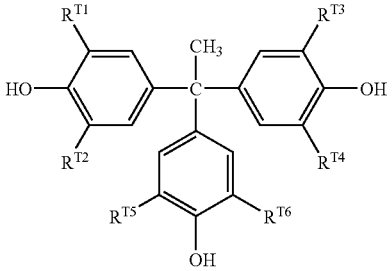
(T-3)
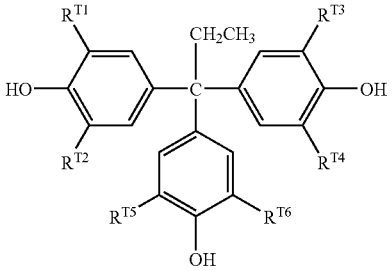
(T-4)
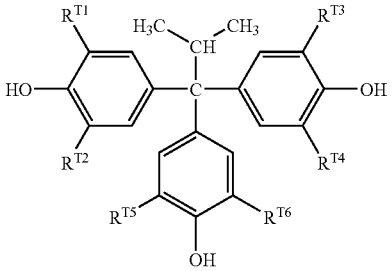
(T-5)
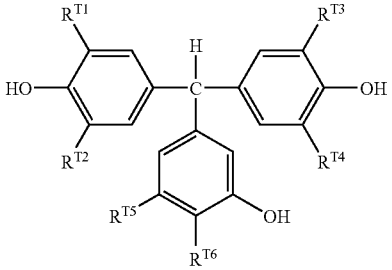
-continued
(T-6)
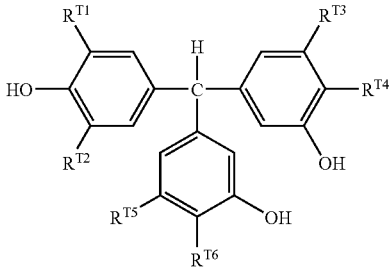
(T-7)
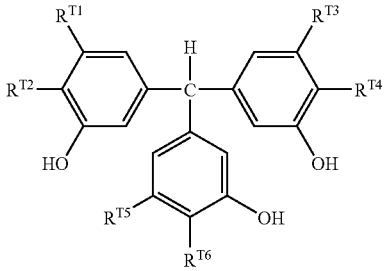
(T-8)
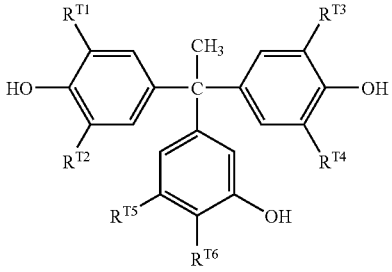
(T-9)
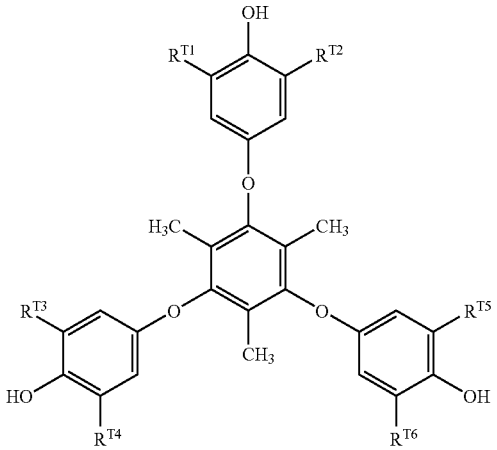
(T-10)
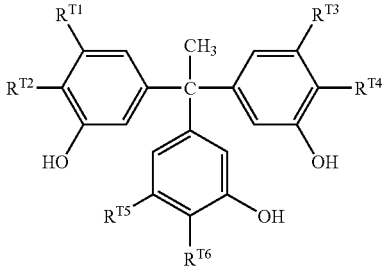

-continued
(T-11)
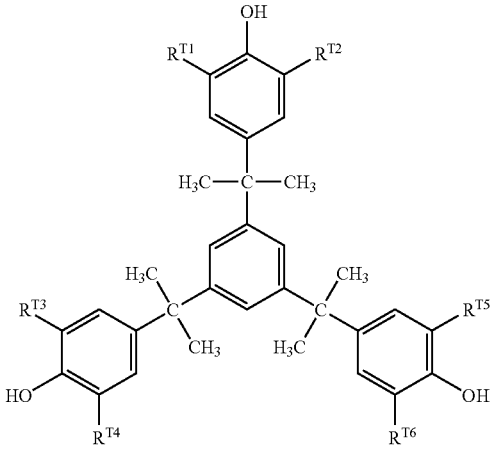
(T-12)
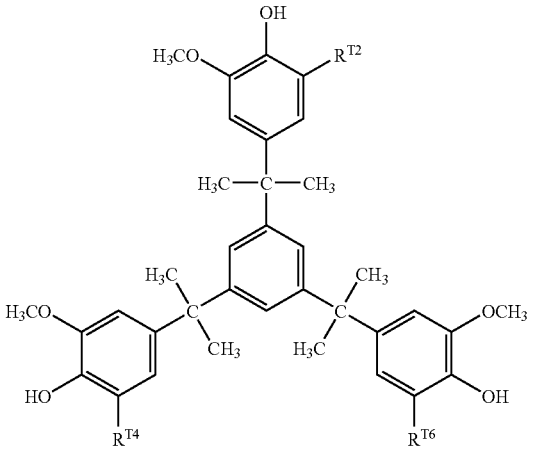
(T-13)
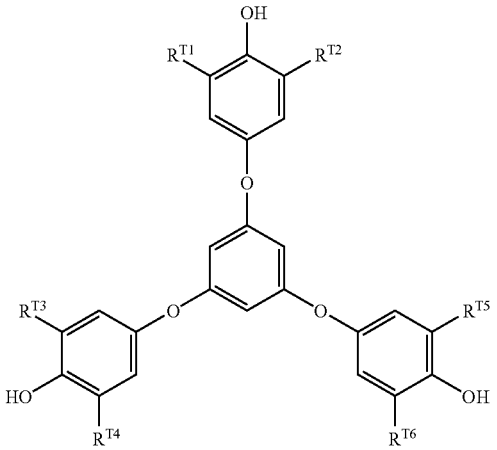
-continued
(T-14)
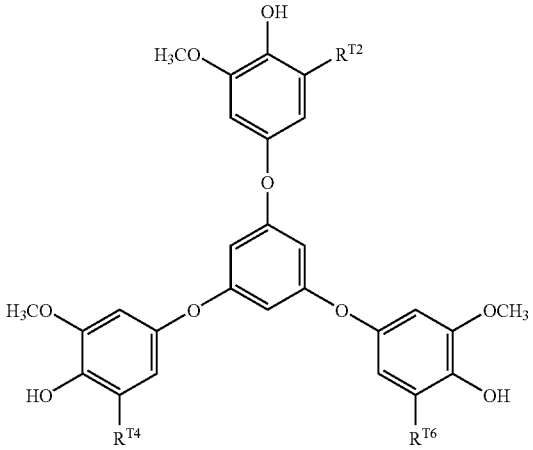
(T-15)
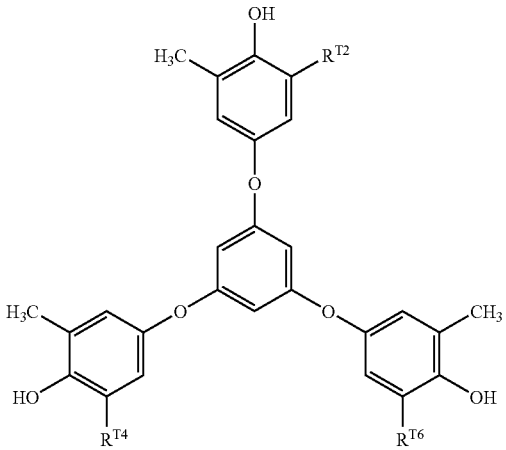
(T-16)
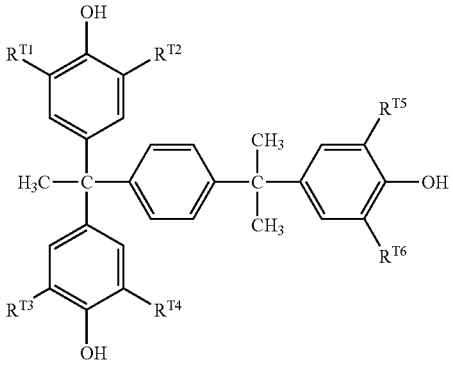

-continued
(T-17)
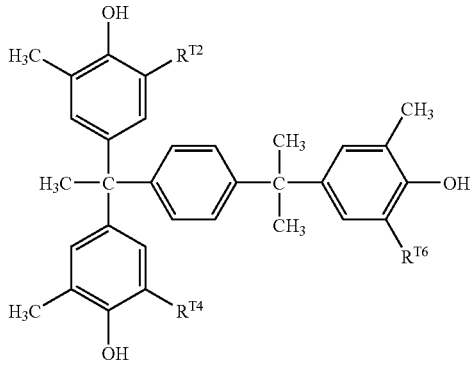
(T-18)
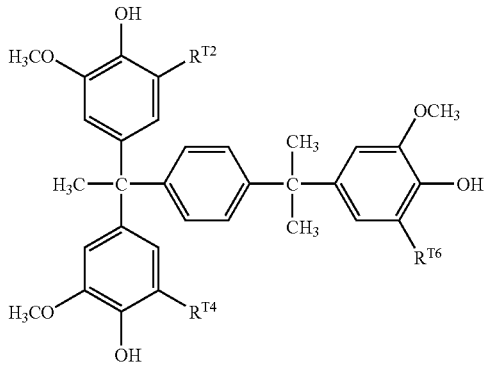
(T-19)
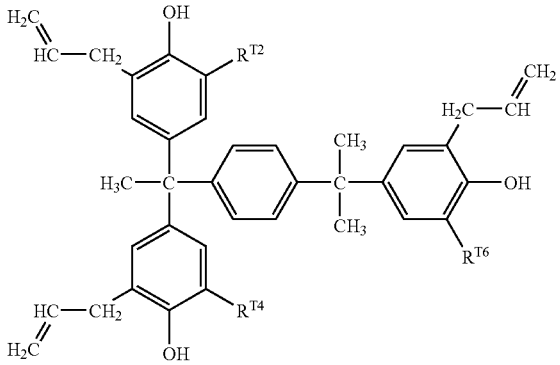
(T-20)
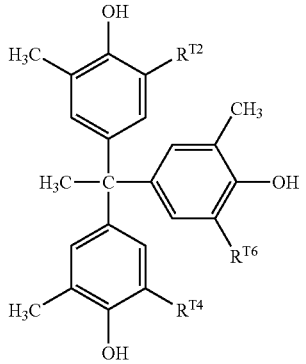
-continued
(T-21)
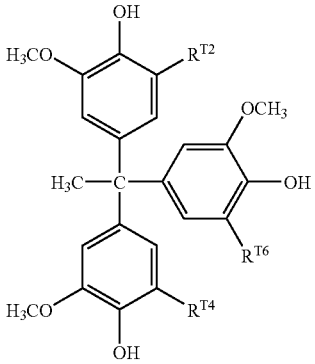
(T-22)
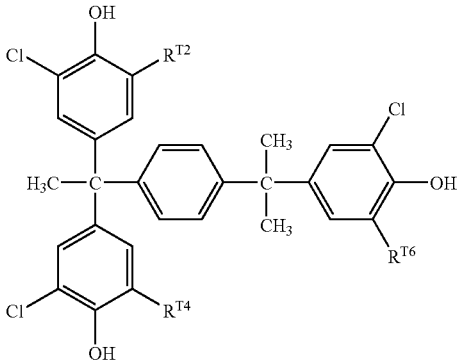
(T-23)
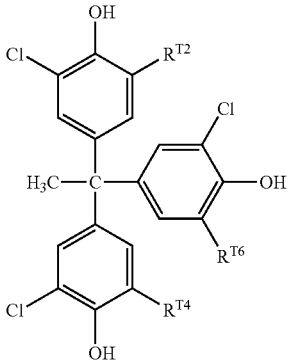
(T-24)
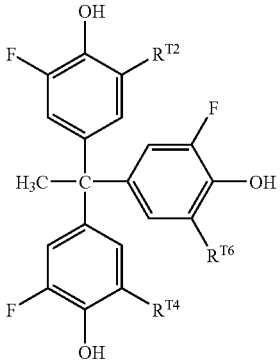

-continued (T-25)

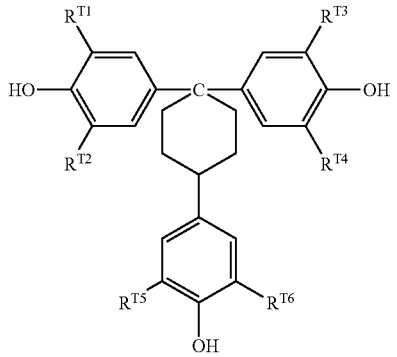

The polyhydroxymethylbisphenol monomer, polyhydroxymethylbisphenol oligomer, polyhydroxymethyltrisphenol monomer and polyhydroxymethyltrisphenol oligomer used in the present invention may be synthesized by, e.g., using as a starting material a bisphenol monomer or trisphenol monomer having a structure in which all the hydroxymethyl groups the bisphenol monomer or trisphenol monomer has have been substituted with hydrogen atoms, and allowing this to react with aldehyde under an alkali condition (hereinafter also "hydroxymethylation reaction"). In this condensation reaction, the number of the hydroxymethyl groups bonded per each polyhydroxymethylbisphenol monomer, polyhydroxymethylbisphenol oligomer, polyhydroxymethyltrisphenol monomer or polyhydroxymethyltrisphenol oligomer can be controlled by controlling the proportion of the starting material bisphenol monomer or trisphenol monomer to the aldehyde, the alkali condition in the reaction system, the reaction temperature, the concentration and so forth.

As described above, it is essential that the polyhydroxymethylbisphenol monomer, polyhydroxymethylbisphenol oligomer, polyhydroxymethyltrisphenol monomer and polyhydroxymethyltrisphenol oligomer each have at least two hydroxymethyl groups, and particularly preferably, at least three hydroxymethyl groups, per each monomer or oligomer. This is because any polymers of a polyhydroxymethylbisphenol monomer, polyhydroxymethylbisphenol oligomer, polyhydroxymethyltrisphenol monomer or polyhydroxymethyltrisphenol oligomer having only one hydroxymethyl group can not have the three-dimensional cross-linked structure and can not attain any sufficient hardness.

The polyhydroxymethylbisphenol oligomer and polyhydroxymethyltrisphenol oligomer, having a higher molecular weight than the polyhydroxymethylbisphenol monomer and polyhydroxymethyltrisphenol monomer, readily turn into varnish, and hence can greatly be improved in film-forming properties. Also, they can readily have a higher crosslink density, and make it easy to obtain films with a higher strength.

The bisphenol unit and trisphenol unit (e.g., a unit derived from the bisphenol monomer having a structure represented by Formula (2) and a unit derived from the trisphenol monomer having a structure represented by Formula (4)) of the polyhydroxymethylbisphenol oligomer and polyhydroxymethyltrisphenol oligomer, respectively, may each preferably be 2 to 5 in number.

As a method of synthesizing the bisphenol oligomer or trisphenol oligomer having a structure in which the bisphenol monomer having a structure represented by Formula (2) or trisphenol monomer having a structure represented by Formula (4) has been condensed through a methylene group (or a method of oligomerizing through a methylene group the bisphenol monomer having a structure represented by Formula (2) or trisphenol monomer having a structure represented by Formula (4): hereinafter also "oligomerization reaction"), a method is available in which, e.g., the bisphenol monomer having a structure represented by Formula (2) or trisphenol monomer having a structure represented by Formula (4) is condensed with formaldehyde under acidic conditions.

The condensation reaction between hydroxymethyl groups at the moiety having already been hydroxymethylated and hydrogen atoms at the moiety having not yet been hydroxymethylated may be made to proceed simultaneously in the course of the above hydroxymethylation reaction, namely, the hydroxymethylation reaction and the oligomerization reaction may be made to proceed simultaneously. This also enables synthesis of the bisphenol oligomer or trisphenol oligomer having a structure in which the bisphenol monomer having a structure represented by Formula (2) or trisphenol monomer having a structure represented by Formula (4) has been condensed through a methylene group and also having at least two hydroxymethyl groups.

The polyhydroxymethylbisphenol monomer, polyhydroxymethylbisphenol oligomer, polyhydroxymethyltrisphenol monomer and/or polyhydroxymethyltrisphenol oligomer to be incorporated in the surface layer of the electrophotographic photosensitive member of the present invention has or have no ability to transport electric charges. Hence, a charge-transporting material or conductive particles must be incorporated in the surface layer of the electrophotographic photosensitive member in order to make electric charges move smoothly.

The charge-transporting material to be incorporated in the surface layer of the electrophotographic photosensitive member is described first.

The charge-transporting material in the surface layer of the electrophotographic photosensitive member may preferably be in a content of from 20 to 80% by weight, and particularly more preferably from 30 to 60% by weight, based on the total weight of the surface layer. It may also preferably be in a content of from 20 to 200% by weight, and particularly more preferably from 50 to 150% by weight, based on the weight of the polymer of polyhydroxymethylbisphenol monomer, polyhydroxymethylbisphenol oligomer, polyhydroxymethyltrisphenol monomer and/or polyhydroxymethyltrisphenol oligomer to be incorporated in the surface layer.

Taking account of the compatibility of the charge-transporting material with the polyhydroxymethylbisphenol monomer, polyhydroxymethylbisphenol oligomer, polyhydroxymethyltrisphenol monomer and polyhydroxymethyltrisphenol oligomer, this charge-transporting material may preferably be a charge-transporting material having a hydroxyl group, and particularly more preferably a charge-transporting material having a hydroxyalkyl group, a hydroxyalkoxyl group or a hydroxyphenyl group.

In the case when the charge-transporting material has a hydroxyalkyl group or a hydroxyalkoxyl group, the charge-transporting material can be improved in solubility in the solvent therefor, and hence the charge transport ability in the surface layer of the electrophotographic photosensitive member can be maintained at a high level. The number of carbon atoms in the alkyl chain of such hydroxyalkyl group or hydroxyalkoxyl group may preferably be from 1 to 8, and particularly more preferably from 3 to 5, in view of the operability or solubility in synthesizing such a charge-transporting material.

In the case when the charge-transporting material has a hydroxyphenyl group, the cross-linking reaction takes place also between this charge-transporting material and the polyhydroxymethylbisphenol monomer, polyhydroxymethylbisphenol oligomer, polyhydroxymethyltrisphenol monomer and/or polyhydroxymethyltrisphenol oligomer in the course of the polymerization reaction (condensation reaction or cross-linking reaction) of the polyhydroxymethylbisphenol monomer, polyhydroxymethylbisphenol oligomer, polyhydroxymethyltrisphenol monomer and/or polyhydroxymethyltrisphenol oligomer. This brings a more improvement in strength of the electrophotographic photosensitive member's surface layer to be formed.

The charge-transporting material to be incorporated in the surface layer of the electrophotographic photosensitive member of the present invention may preferably be a charge-transporting material having a triarylamine structure (i.e., a triarylamine compound), and particularly more preferably a charge-transporting material having a triphenylamine structure (i.e., a triphenylamine compound).

Specific examples of the a charge-transporting material having a hydroxyl group are shown below.

(C-1)

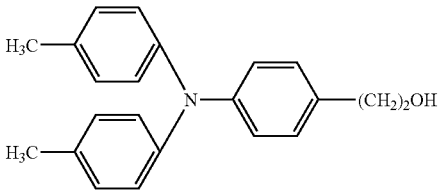

(C-2)

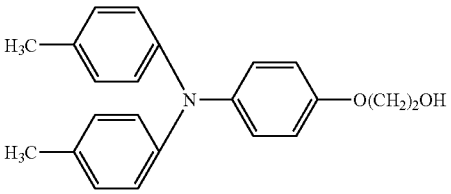

(C-3)

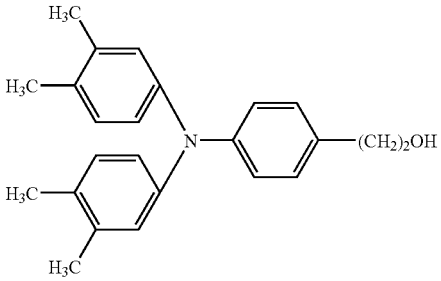

(C-4)

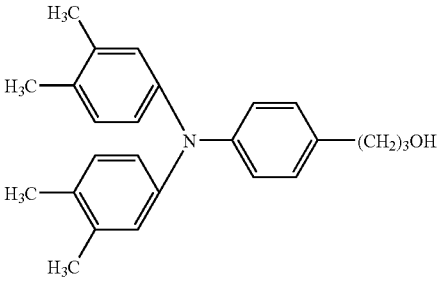

(C-5)

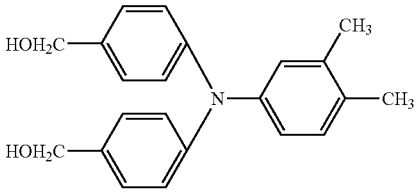

(C-6)

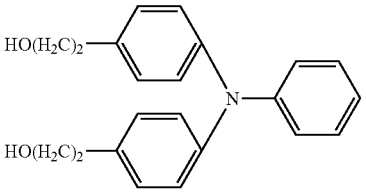

(C-7)

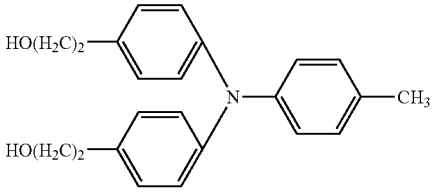

(C-8)

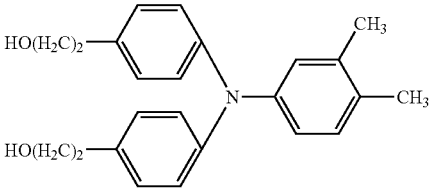

(C-9)

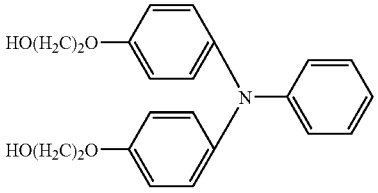

(C-10)

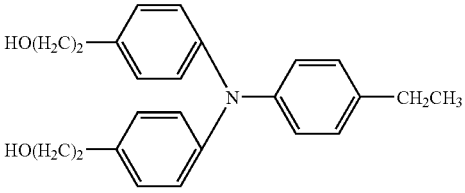

-continued
(C-11)
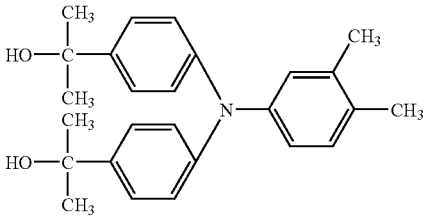
(C-12)
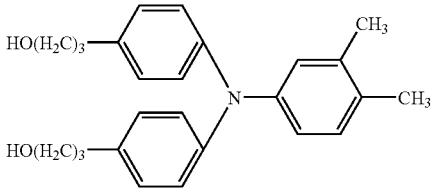
(C-13)
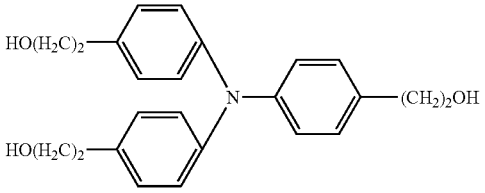
(C-14)
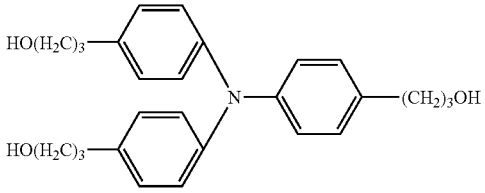
(C-15)
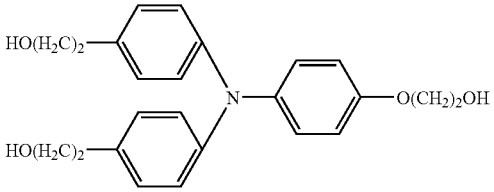
(C-16)
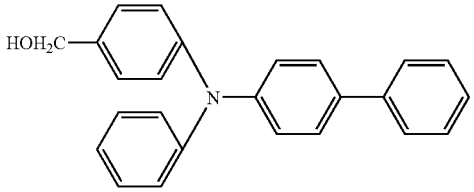
(C-17)
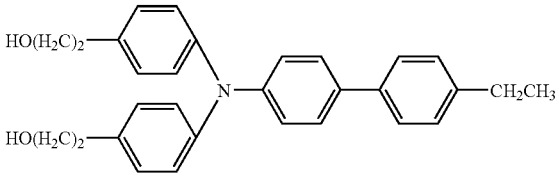
(C-18)
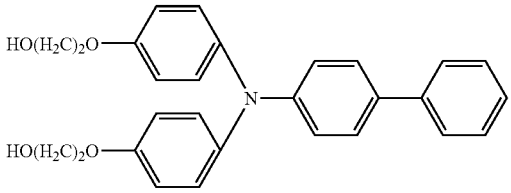
(C-19)
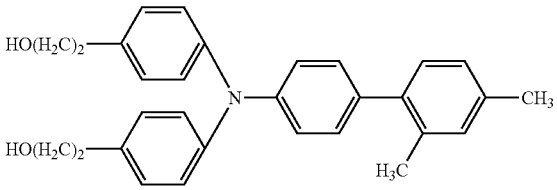
(C-20)
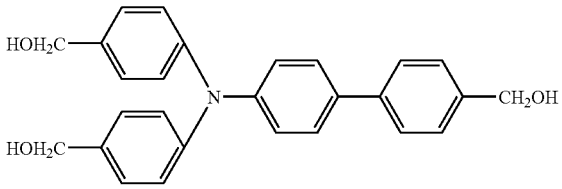
(C-21)
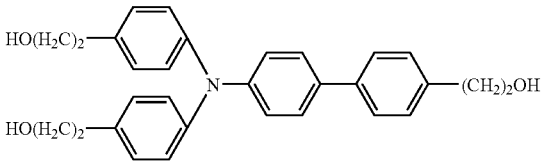
(C-22)
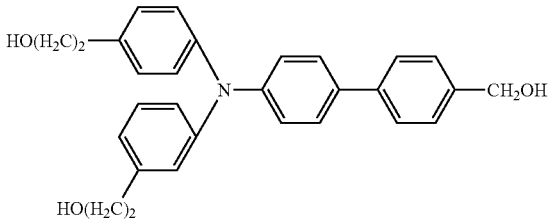
(C-23)
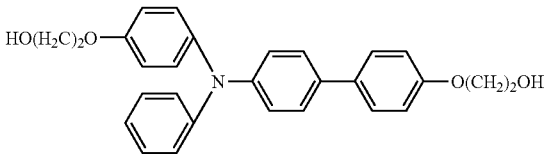
(C-24)
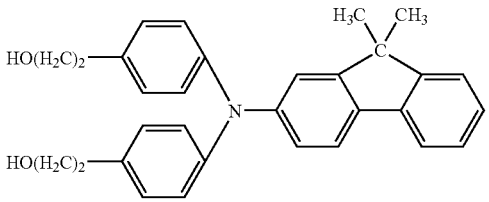

-continued
(C-25)
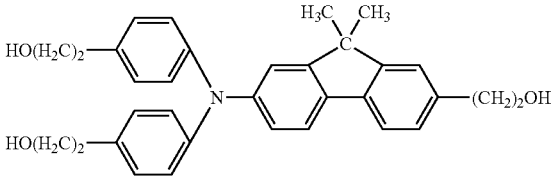
(C-26)
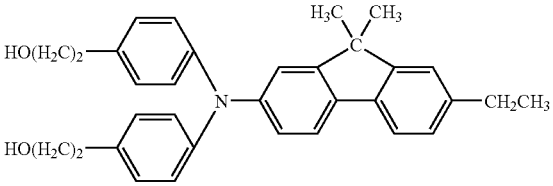
(C-27)
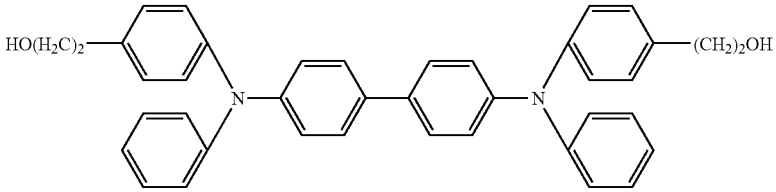
(C-28)
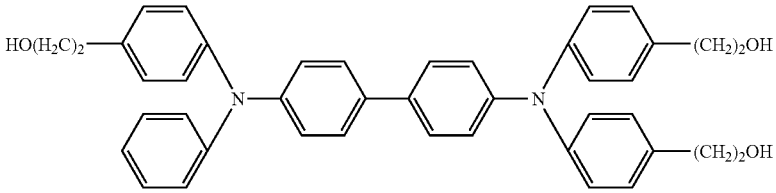
(C-29)
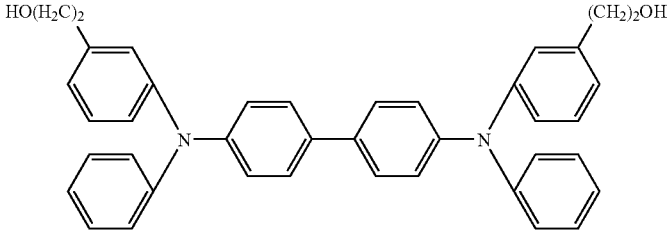
(C-30)
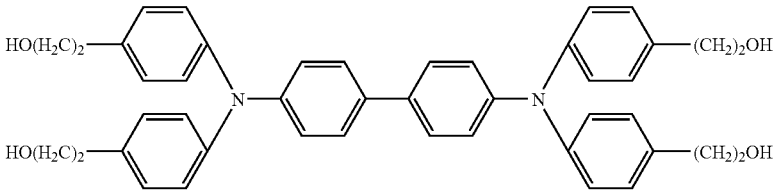
(C-31)
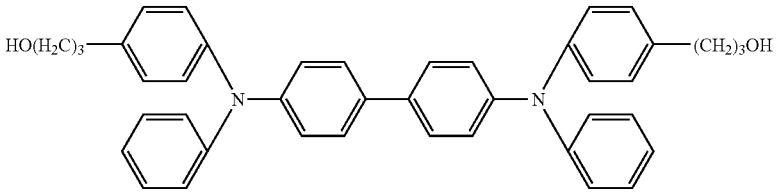
(C-32)
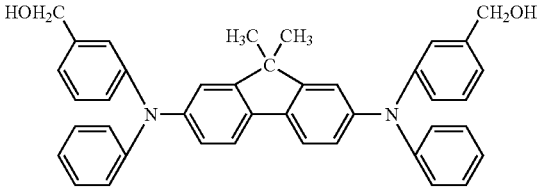
(C-33)
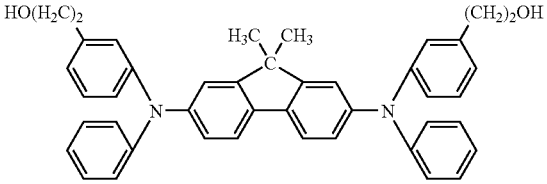

-continued
(C-34)
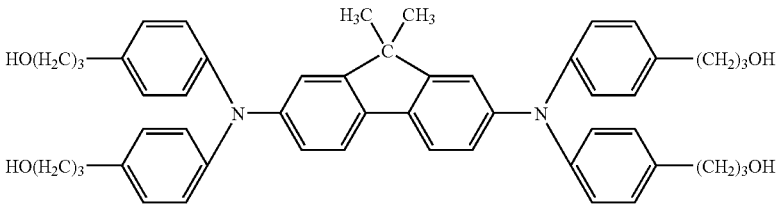
(C-35)
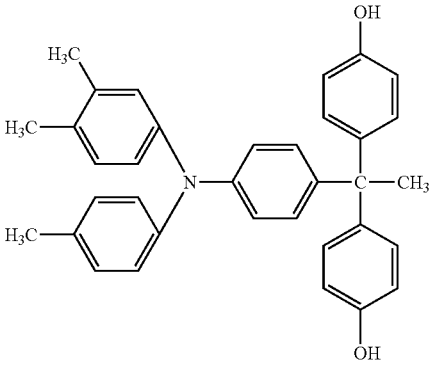
(C-36)
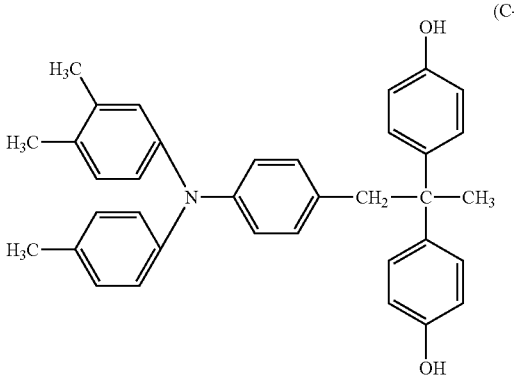
(C-37)
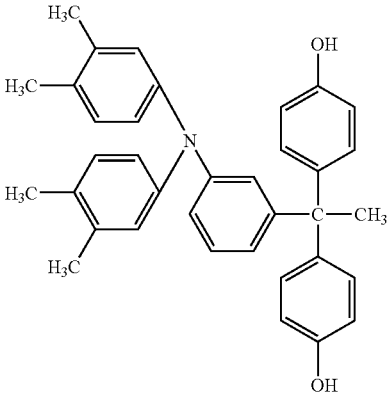
(C-38)
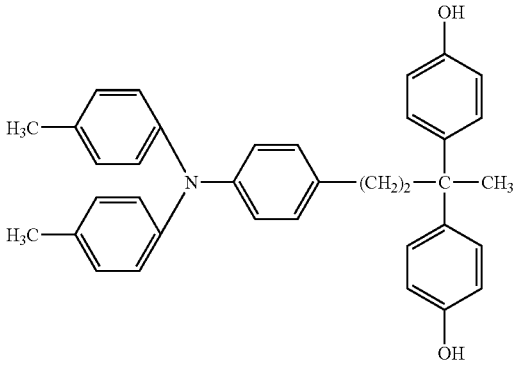
(C-39)
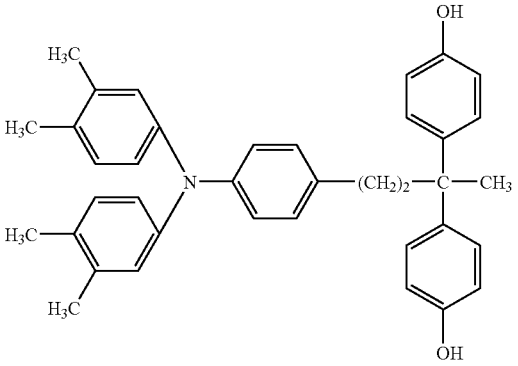
(C-40)
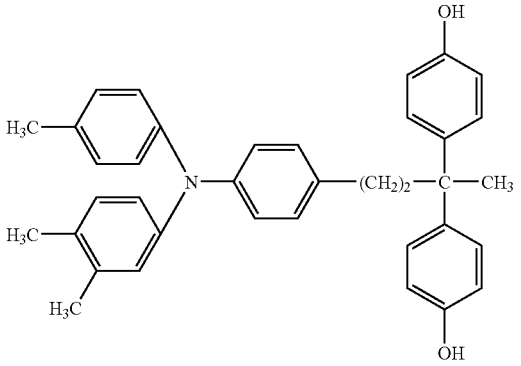

-continued
(C-41)
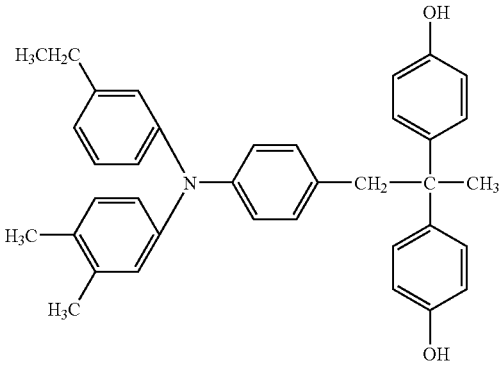
(C-42)
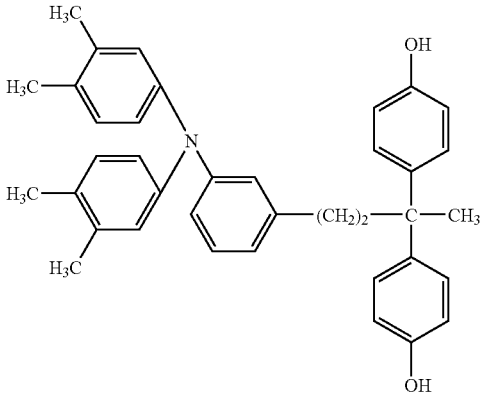
(C-43)
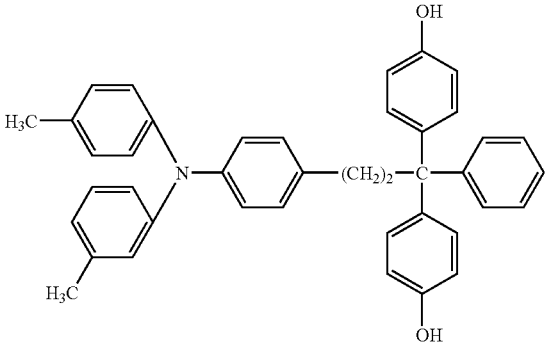
(C-44)
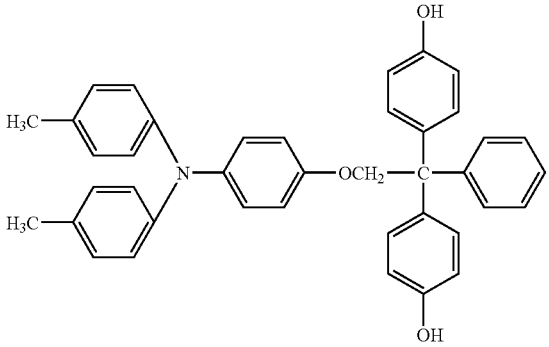
(C-45)
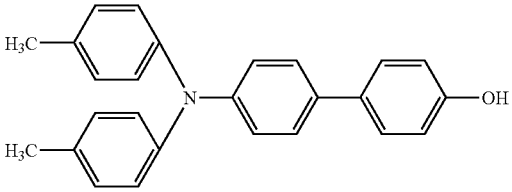
(C-46)
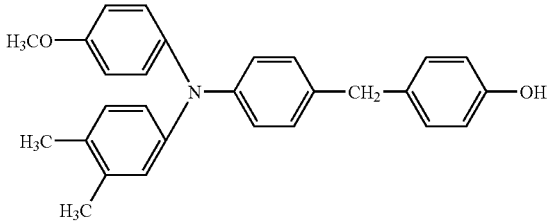
(C-47)
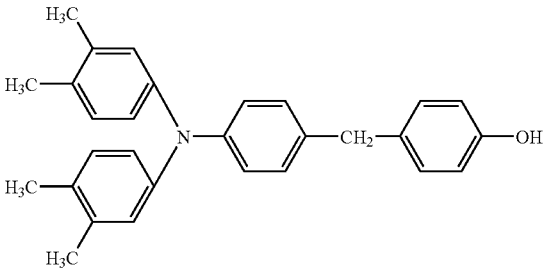
(C-48)
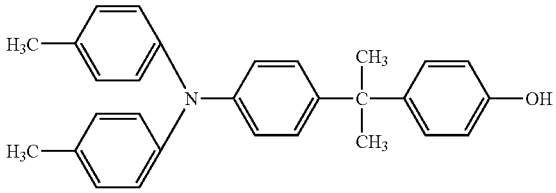
(C-49)
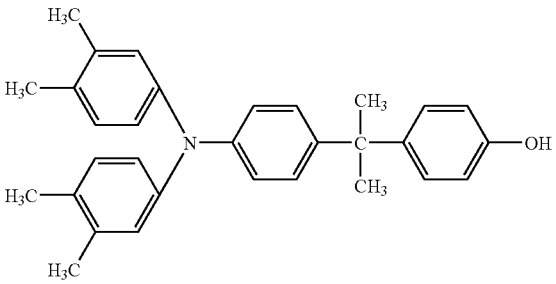
(C-50)
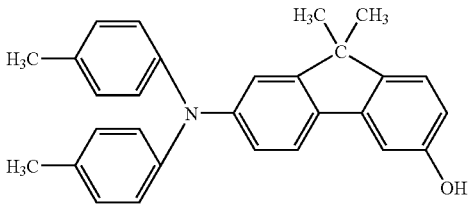

-continued (C-51)

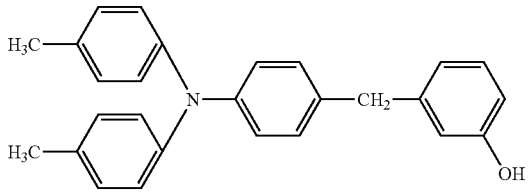

(C-52)

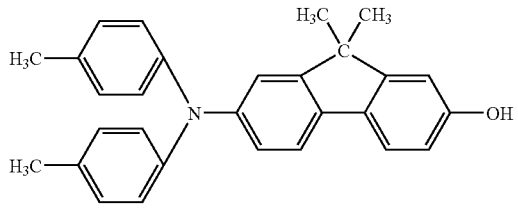

(C-53)

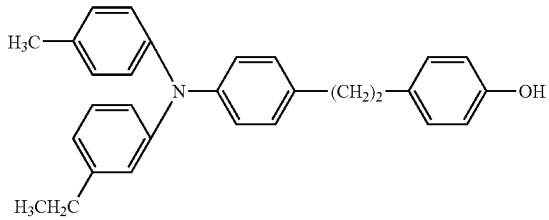

(C-54)

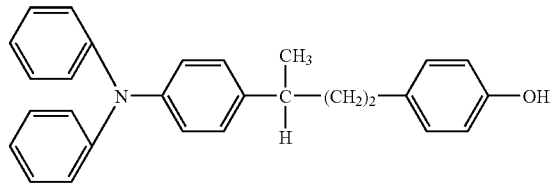

(C-55)

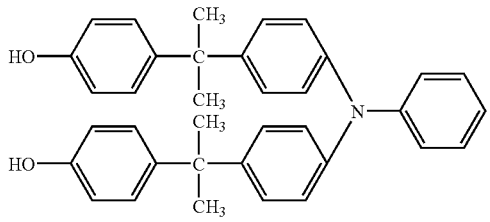

(C-56)

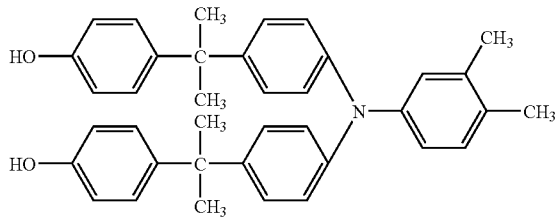

(C-57)

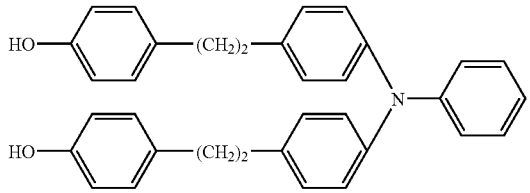

(C-58)

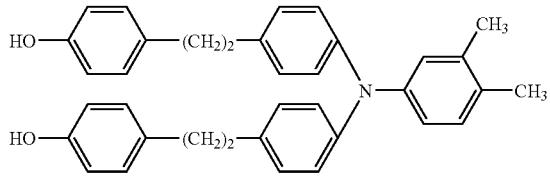

(C-59)

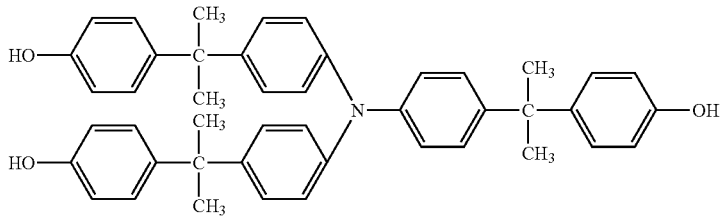

(C-60)

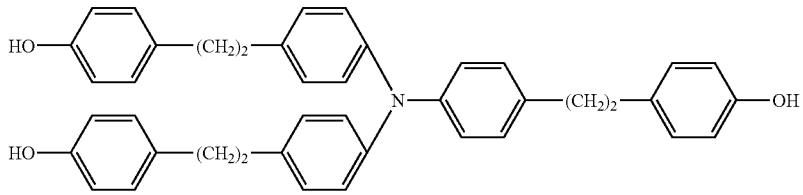

The conductive particles to be incorporated in the surface layer of the electrophotographic photosensitive member are described below.

The conductive particles in the surface layer of the electrophotographic photosensitive member of the present invention may preferably be in a content of from 20 to 70% by weight, and particularly more preferably from 30 to 60% by weight, based on the total weight of the surface layer. They may also preferably be in a content of from 10 to 60% by weight, and particularly more preferably from 20 to 50% by weight, based on the total weight of the polymer of polyhydroxymethylbisphenol monomer, polyhydroxymethylbisphenol oligomer, polyhydroxymethyltrisphenol monomer and/or polyhydroxymethyltrisphenol oligomer.

The conductive particles may include metal particles, metal oxide particles, conductive polymer particles and carbon black. The metal may include aluminum, zinc, copper, chromium, nickel, stainless steel and silver. Plastic particles on the surfaces of which any of these metals has been vacuum-deposited may also be used. The metal oxide may include zinc oxide, titanium oxide, tin oxide, antimony oxide, indium oxide, bismuth oxide, tin-doped indium oxide, tantalum-doped tin oxide, tungsten-doped tin oxide, antimony-doped tin oxide, and zirconium oxide. The conductive polymer may include polyacetylene, polythiophene and polypyrrole.

Of these conductive particles, particularly preferred are zinc oxide, titanium oxide, tin oxide, antimony oxide, indium oxide, bismuth oxide, tin-doped indium oxide, tantalum-doped tin oxide, tungsten-doped tin oxide and antimony-doped zirconium oxide.

Any of these conductive particles may be used alone or may be used in combination of two or more types. When used in combination of two or more types, they may merely be blended or may be made into a solid solution or a fused solid.

The conductive particles used in the present invention may preferably have an average particle diameter of 0.3 μm or less, and particularly more preferably 0.1 μm or less, in view of the prevention of light scattering. The use of metal oxides is also more preferred in view of transparency.

Any electrophotographic photosensitive member satisfying electrophotographic performance may be not obtainable unless the surface layer itself of the electrophotographic photosensitive member has conductivity to a certain extent. Accordingly, the surface layer must be incorporated with at least one of the charge-transporting material and the conductive particles so as to have electrical resistance value described below.

In the present invention, the surface layer of the electrophotographic photosensitive member may preferably have a volume resistivity of from $10^{10}$ to $10^{15}$ Ω·cm, and particularly more preferably from $10^{11}$ to $10^{14}$ Ω·cm. If the surface layer has a volume resistivity of less than $10^{10}$ Ω·cm, electric charges may be retained with difficulty to cause smeared images. If on the other hand the surface layer has a volume resistivity of more than $10^{15}$ Ω·cm, electric charges may move with difficulty to cause density decrease and negative ghost.

The volume resistivity may be measured in the following way.

First, a layer corresponding to the surface layer of the electrophotographic photosensitive member is provided in a thickness of T=3 (μm) on comb type platinum electrodes having an electrode-to-electrode distance D=180 (μm) and a length L=5.9 (cm). Then, electric current value I (A) when a DC voltage V=100 (V) is applied across the comb type platinum electrodes is measured with a picoampere meter (pA meter), and volume resistivity ρv (Ω·cm) is found according to the following equation:

$$\rho v=(V/I)\times(T\times L/D).$$

The conductive particles may preferably be used after they have been surface-treated. As a surface-treating agent used when they are surface-treated, it may include silane coupling agents, silicone oils, siloxane compounds and surface-active agents. In view of the dispersibility and dispersion stability of the conductive particles, it is particularly effective to use a fluorine-atom-containing surface-treating agent such as a fluorine-atom-containing silane coupling agent, a fluorine-atom-containing silicone oil and a fluorine-atom-containing surface-active agent.

Specific examples of the fluorine-atom-containing silane coupling agent are shown below.

| Fluorine-atom-containing silane coupling agent |
|---|
| $CF_3CH_2CH_2Si(OCH_3)_3$ |
| $C_{10}F_{21}CH_2CH_2SCH_2CH_2Si(OCH_3)_3$ |
| $C_4F_9CH_2CH_2Si(OCH_3)_3$ |
| $C_6F_{13}CH_2CH_2Si(OCH_3)_3$ |
| $C_8F_{17}CH_2CH_2Si(OCH_3)_3$ |
| $C_8F_{17}CH_2CH_2Si(OCH_2CH_2CH_3)_3$ |
| $C_{10}F_{21}Si(OCH_3)_3$ |
| $C_6F_{13}CONHSi(OCH_3)_3$ |
| $C_8F_{17}CONHSi(OCH_3)_3$ |
| $C_7F_{15}CONHCH_2CH_2CH_2Si(OCH_3)_3$ |
| $C_7F_{15}CONHCH_2CH_2CH_2Si(OCH_2CH_3)_3$ |
| $C_7F_{15}COOCH_2CH_2CH_2Si(OCH_3)_3$ |
| $C_7F_{15}COSCH_2CH_2CH_2Si(OCH_3)_3$ |
| $C_7F_{15}SO_2NHCH_2CH_2CH_2Si(OCH_3)_3$ |
| $C_7F_{15}SO_2N(CH_2CH_3)CH_2CH_2CH_2Si(OCH_3)_3$ |
| $C_8F_{17}CH_2CH_2SCH_2CH_2Si(OCH_3)_3$ |

Specified examples of the fluorine-atom-containing silicone oil are shown below.

Fluorine-atom-containing silicone oil

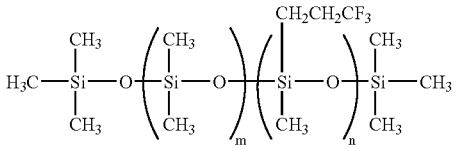

m, n: Positive integer

Specific examples of the fluorine-atom-containing surface-active agent are shown below.

| Fluorine-atom-containing surface-active agent |
|---|
| $X—SO_2NRCH_2COOH$ |
| $X—SO_2NRCH_2CH_2O(CH_2CH_2O)_nH$ |
| $X—SO_4N(CH_2CH_2CH_2OH)_2$ |
| $X—RO(CH_2CH_2O)_nH$ |
| $X—(RO)_nH$ |
| $X—(RO)_nR$ |
| $X—SO_2NRCH_2CH(\backslash O/)CH_2$ |
| $X—COOH$ |
| $X—CH_2CH_2COOH$ |
| $X—ORCOOH$ |
| $X—ORCH_2COOH$ |
| $X—SO_3H$ |
| $X—ORSO_3H$ |
| $X—CH_2CH_2OH$ |
| $X—CH_2OCH_2CH(\backslash O/)CH_2$ |
| $X—CH_2CH_2OCH_2CH(\backslash O/)CH_2$ |

-continued

| Fluorine-atom-containing surface-active agent |
| --- |
| $X—COOCH_2CH\underset{\diagdown O \diagup}{}CH_2$ |

R: Alkyl group, aryl group or aralkyl group
X: Perfluoroalkyl group such as $—CF_3$, $—C_4F_9$ or $—C_8F_{17}$
n: 5, 10 or 15

Doped tin oxide particles are particularly preferred as the conductive particles. They may be surface-treated in the following way.

First, the tin oxide particles and the surface-treating agent are mixed and dispersed in a suitable solvent to make the surface-treating agent adhere to the tin oxide particle surfaces. As a means for dispersion, a dispersion means such as a ball mill or a sand mill may be used. Next, the solvent is removed from the resultant liquid dispersion to make the surface-treating agent fix to the tin oxide particle surfaces. After this treatment, heat treatment may further optionally be carried out. Also, in the surface-treating dispersion, a catalyst for accelerating the reaction may be added. Still also, the tin oxide particles having been surface-treated may further optionally be subjected to pulverization treatment. The proportion of the surface-treating agent to the tin oxide particles depends on the latter's particle diameter. The former may preferably be in an amount of from 1 to 65% by weight, and particularly more preferably from 5 to 50% by weight, based on the total weight of the latter tin oxide particles.

To the surface layer of the electrophotographic photosensitive member of the present invention, fluorine-atom-containing resin particles such as polytetrafluoroethylene resin particles or resin particles such as silicone resin particles may also be added.

As the solvent used to prepare a coating solution for the surface layer of the electrophotographic photosensitive member, a solvent is preferable which sufficiently dissolves the polyhydroxymethylbisphenol monomer, polyhydroxymethylbisphenol oligomer, polyhydroxymethyltrisphenol monomer and/or polyhydroxymethyltrisphenol oligomer and the charge-transporting material, and also does not adversely affect the underlying layer (such as the charge generation layer or the charge transport layer) with which the surface layer coating solution is to come into contact.

Accordingly, usable as the solvent used to prepare the surface layer coating solution are alcohols such as methanol, ethanol and 2-propanol, ketones such as acetone, cyclohexanone and methyl ethyl ketone, esters such as methyl acetate and ethyl acetate, ethers such as tetrahydrofuran and dioxane, aromatic hydrocarbons such as toluene and xylene, and hydrocarbons substituted with a halogen atom, such as chlorobenzene and dichloromethane. Of these, alcohols such as methanol, ethanol and 2-propanol are preferable. Plural kinds of solvents may also be used in the form of a mixture.

Commonly available charge-transporting materials are insoluble or slightly soluble in alcohol type solvents. Hence, it is difficult to uniformly dissolve the polyhydroxymethylbisphenol monomer, polyhydroxymethylbisphenol oligomer, polyhydroxymethyltrisphenol monomer and/or polyhydroxymethyltrisphenol oligomer and the charge-transporting material by using alcohol type solvents. Accordingly, the charge-transporting material having a hydroxymethyl group as described above may be used as the charge-transporting material. Since it is soluble in alcohol type solvents, its use makes it easy to uniformly dissolve the polyhydroxymethylbisphenol monomer, polyhydroxymethylbisphenol oligomer, polyhydroxymethyltrisphenol monomer and/or polyhydroxymethyltrisphenol oligomer and the charge-transporting material even when an alcohol type solvent that may less affect the underlying layer such as the charge generation layer is used.

When the coating solution for the surface layer of the electrophotographic photosensitive member of the present invention is coated, any of coating methods may be used, such as dip coating, spray coating, spinner coating, roller coating, Meyer bar coating and blade coating.

In the present invention, heat treatment may be carried out to effect the curing reaction of the polyhydroxymethylbisphenol monomer, polyhydroxymethylbisphenol oligomer, polyhydroxymethyltrisphenol monomer and/or polyhydroxymethyltrisphenol oligomer. This heat treatment may be carried out in combination with a drying step for removing the solvent of the surface layer coating solution after the surface layer has been formed by coating.

Conditions for curing reaction by such heat treatment may appropriately be controlled in accordance with factors such as the desired surface layer hardness, the layer thickness of the surface layer, the reactivity of monomers and the thermal deterioration of the photosensitive layer itself. Heating temperature may preferably be set to from 100° C. to 180° C., and particularly more preferably from 120° C. to 165° C. Heating time may preferably be set to from 10 minutes to 120 minutes, particularly more preferably from 20 minutes to 90 minutes, and still more preferably from 30 minutes to 70 minutes. The step of stepwise raising and dropping temperature may also be provided in regard to the heating temperature.

To the interior of the surface layer of the electrophotographic photosensitive member of the present invention, an additive such as an antioxidant may be added for the purpose of preventing the surface layer from deteriorating because of any active substances such as ozone and nitrogen oxide generated at the time of charging.

The layer thickness of the surface layer of the electrophotographic photosensitive member of the present invention depends on the layer construction of the electrophotographic photosensitive member. Any too thin surface layer may damage the durability or running performance of the electrophotographic photosensitive member. Any too thick surface layer may cause a rise of residual potential that is due to the providing of the surface layer. Accordingly, the surface layer must be formed in an appropriate thickness. Stated specifically, where the photosensitive layer (in the case of those shown in FIGS. 1A, 1B and 1C, the charge transport layer 2) is provided thereon with the layer 1 separately which contains the polymer of polyhydroxymethylbisphenol monomer, polyhydroxymethylbisphenol oligomer, polyhydroxymethyltrisphenol monomer and/or polyhydroxymethyltrisphenol oligomer and the charge-transporting material, the surface layer may preferably be in a thickness of from 0.1 μm to 10 μm, and particularly more preferably from 0.5 μm to 7 μm. Meanwhile, as in the case of the one shown in FIG. 1D, the charge generation layer 3 is provided thereon with the layer 1 which contains the polymer of polyhydroxymethylbisphenol monomer, polyhydroxymethylbisphenol oligomer, polyhydroxymethyltrisphenol monomer and/or polyhydroxymethyltrisphenol oligomer and the charge-transporting material, the surface layer may preferably be in a thickness of from 3 μm to 40 μm, and particularly more preferably from 8 μm to 20 μm.

Figure 2:
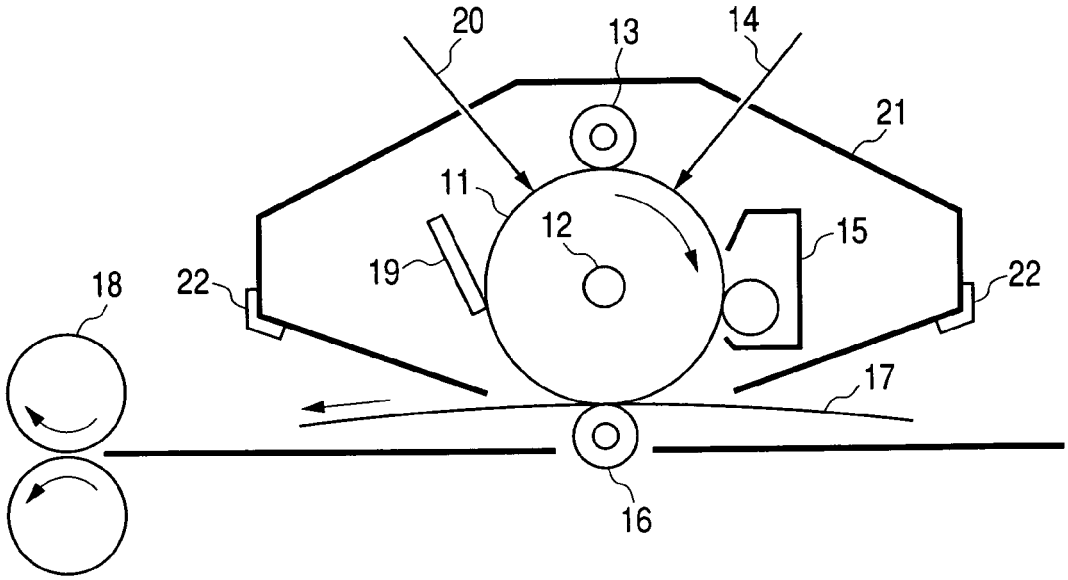
FIG. 2 is a schematic view showing the construction of an electrophotographic apparatus provided with a process cartridge having the electrophotographic photosensitive member of the present invention.

FIG. 2 schematically illustrates the construction of an electrophotographic apparatus provided with a process cartridge having the electrophotographic photosensitive member of the present invention.

In FIG. 2, reference numeral 11 denotes a drum-shaped electrophotographic photosensitive member of the present invention, which is rotatingly driven around an axis 12 in the direction of an arrow at a stated peripheral speed. The electrophotographic photosensitive member 11 is, in the course of its rotation, uniformly electrostatically charged on its periphery to a positive or negative, given potential through a charging means (primary charging means) 13. The electrophotographic photosensitive member thus charged is then exposed to exposure light (imagewise exposure light) 14 emitted from an exposure means (not shown) for slit exposure or laser beam scanning exposure. In this way, electrostatic latent images corresponding to the intended image information are successively formed on the periphery of the electrophotographic photosensitive member 11.

The electrostatic latent images thus formed are subsequently developed with toner by the operation of a developing means 15. The toner images thus formed and held on the surface of the electrophotographic photosensitive member 11 are then successively transferred by the operation of a transfer means 16, to a transfer material 17 fed from a paper feed section (not shown) to the part between the electrophotographic photosensitive member 11 and the transfer means 16 in the manner synchronized with the rotation of the electrophotographic photosensitive member 11.

The transfer material 17 onto which the toner images have been transferred is separated from the peripheral surface of the electrophotographic photosensitive member, is led through an image fixing means 18, where the toner images are fixed, and is then put out of the apparatus as an image-formed material (a print or copy).

The peripheral surface of the electrophotographic photosensitive member 11 from which images have been transferred is brought to removal of the toner remaining after the transfer, through a cleaning means 19. Thus, its surface is cleaned. The electrophotographic photosensitive member is further subjected to charge elimination by pre-exposure light 20 emitted from a pre-exposure means (not shown), and then repeatedly used for the formation of images. Incidentally, where the primary charging means 13 is a contact charging means making use of a charging roller or the like, the pre-exposure is not necessarily required.

In the present invention, the apparatus may be constituted of a combination of plural components integrally joined in a container as a process cartridge from among the constituents such as the above electrophotographic photosensitive member 11, charging means 13, developing means 15 and cleaning means 19 so that the process cartridge is detachably mountable to the main body of an electrophotographic apparatus such as a copying machine or a laser beam printer. For example, at least one of the primary charging means 13, the developing means 15 and the cleaning means 19 may integrally be supported in a cartridge together with the electrophotographic photosensitive member 11 to form a process cartridge 21 that is detachably mountable to the main body of the apparatus through a guide means 22 such as rails provided in the main body of the apparatus.

In the case when the electrophotographic apparatus is a copying machine or a printer, the exposure light 14 is light reflected from, or transmitted through, an original, or light irradiated by the scanning of a laser beam, the driving of an LED array or the driving of a liquid-crystal shutter array according to signals obtained by reading an original through a sensor and converting the information into signals.

The electrophotographic photosensitive member of the present invention may be not only applied in electrophotographic copying machines and laser beam printers, but also widely applied in the fields where electrophotography is applied, e.g., CRT printers, LED printers, FAX, liquid-crystal printers, and laser platemaking.

The present invention is described below in greater detail by giving Examples specifically. Note, however, that the present invention is by no means limited to these Examples. In the following Examples and Comparative Examples, "part(s)" refers to "part(s) by weight."

EXAMPLE 1

On an aluminum cylinder (JIS A 3003 aluminum alloy) as a support, having a length of 260.5 mm and a diameter of 30 mm, a 5% by weight methanol solution of a polyamide resin (trade name: AMILAN CM8000; available from Toray Industries, Inc.) was coated by dip coating, followed by drying to form an intermediate layer with a layer thickness of 0.5 μm.

Next, as a charge-generating material, 3 parts of hydroxygallium phthalocyanine of a crystal form having the strongest peak at a Bragg's angle (2θ±0.2°) of 28.1° in the CuKα characteristic X-ray diffraction and 2 parts of polyvinyl butyral resin (trade name: S-LEC BX-1; available from Sekisui Chemical Co., Ltd.) were added to 100 parts of cyclohexanone, and these were subjected to dispersion for 1 hour by means of a sand mill making use of glass beads of 1 mm in diameter, followed by addition of 100 parts of methyl ethyl ketone to make dilution to prepare a charge generation layer coating dispersion. This charge generation layer coating dispersion was dip-coated on the above intermediate layer, followed by drying at 90° C. for 10 minutes to form a charge generation layer with a layer thickness of 0.17 μm.

Next, 7.5 parts of a charge-transporting material having a structure represented by the following formula:

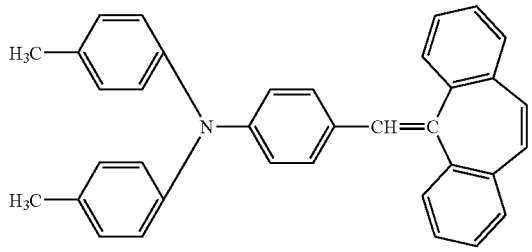

and as a binder resin 10 parts of bisphenol-Z polycarbonate (trade name: IUPILON Z-200; available from Mitsubishi Gas Chemical Company, Inc.) were dissolved in a mixed solvent of 60 parts of monochlorobenzene and 20 parts of dichloromehtane to prepare a charge transport layer coating solution. This charge transport layer coating solution was dip-coated on the above charge generation layer, followed by hot-air drying at 110° C. for 1 hour to form a charge transport layer with a layer thickness of 19 μm.

Next, 10 parts of a bisphenol monomer having a structure represented by the above formula (B-3) (all the $R^{B1}$ to $R^{B4}$ are hydroxymethyl groups) and 7 parts of a charge-transporting material having a structure represented by the above formula (C-12) were dissolved in 40 parts of ethyl alcohol (a solvent) to prepare a surface layer coating solution, which was then dip-coated on the above charge transport layer, followed by hot-air drying at 155° C. for 1 hour to provide a layer (surface layer) with a layer thickness of 3 μm. The layer thickness was measured with an interference layer thickness meter (manufactured by Ohtsuka Denshi K.K.). This surface layer coating solution had so good stability that any great change in liquid properties was not particularly seen even when the coating solution was circulated for 24 hours in an environment of temperature 23° C./humidity 50% RH.

Electrophotographic performance of the electrophotographic photosensitive member thus obtained was evaluated by fitting it to a remodeled machine of a laser beam printer (trade name: LBP-NX; manufactured by CANON INC.; employing a contact charging method making use of a charging roller; using as an applied voltage a voltage formed by superimposing an AC voltage on a DC voltage), having the construction shown in FIG. 2. Its charging was so set that the dark-area potential came to −700 V, and the amount of light that was necessary when this photosensitive member was irradiated with laser light of 780 nm in wavelength to lower the potential of −700 V to −200 V was measured to regard it as sensitivity. The potential when the photosensitive member was irradiated with light in an amount of 20 $\mu J/cm^2$ was also measured as residual potential Vr. The depth of wear was still also measured which was as a result of a 10,000-sheet running test made using the like laser beam printer.

EXAMPLE 2

An electrophotographic photosensitive member was produced in the same manner as in Example 1 except that the charge generation layer formed therein was provided in the following way. Evaluation was made in the same way.

That is, as a charge-generating material, 4 parts of oxytitanium phthalocyanine of a crystal form having strong peaks at Bragg's angles (2θ±0.2°) of 9.5° and 27.1° in the CuKα characteristic X-ray diffraction and 2 parts of polyvinyl butyral resin (trade name: S-LEC BX-1; available from Sekisui Chemical Co., Ltd.) were added to 100 parts of cyclohexanone, and these were subjected to dispersion for 4.5 hours by means of a sand mill making use of glass beads of 1 mm in diameter, followed by addition of 130 parts of ethyl acetate to make dilution to prepare a charge generation layer coating dispersion. This charge generation layer coating dispersion was dip-coated on the intermediate layer, followed by drying at 90° C. for 10 minutes to form a charge generation layer with a layer thickness of 0.18 μm.

EXAMPLE 3

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-5) (all the $R^{B1}$ to $R^{B4}$ are hydroxymethyl groups). Evaluation was made in the same way.

EXAMPLE 4

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-14) (all the $R^{B1}$ to $R^{B4}$ are hydroxymethyl groups). Evaluation was made in the same way.

EXAMPLE 5

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-26) (all the $R^{B1}$ to $R^{B4}$ are hydroxymethyl groups). Evaluation was made in the same way.

EXAMPLE 6

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-28) (all the $R^{B1}$ to $R^{B4}$ are hydroxymethyl groups). Evaluation was made in the same way.

EXAMPLE 7

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-34) (all the $R^{B1}$ to $R^{B4}$ are hydroxymethyl groups). Evaluation was made in the same way.

EXAMPLE 8

An electrophotographic photosensitive member was produced in the same manner as in Example 1 except that the bisphenol monomer used therein, having a structure represented by the above formula (B-3) (all the $R^{B3}$ to $R^{B4}$ are hydroxymethyl groups) was changed for a bisphenol monomer having a structure represented by the above formula (B-35) (all the $R^{B1}$ to $R^{B4}$ are hydroxymethyl groups). Evaluation was made in the same way.

EXAMPLE 9

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-50) (all the $R^{B2}$ and $R^{B3}$ are hydroxymethyl groups). Evaluation was made in the same way.

EXAMPLE 10

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-53) (all the $R^{B1}$ to $R^{B4}$ are hydroxymethyl groups). Evaluation was made in the same way.

EXAMPLE 11

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-55) (all the $R^{B1}$ to $R^{B4}$ are hydroxymethyl groups). Evaluation was made in the same way.

EXAMPLES 12 to 20

Electrophotographic photosensitive members were produced in the same manner as in Example 5 except that the charge-transporting material used therein, having a structure represented by the above formula (C-12) was changed for a charge-transporting material having a structure represented by the above formula (C-4), a charge-transporting material having a structure represented by the above formula (C-14), a charge-transporting material having a structure represented by the above formula (C-17), a charge-transporting material having a structure represented by the above formula (C-30), a charge-transporting material having a structure represented by the above formula (C-31), a charge-transporting material having a structure represented by the above formula (C-35), a charge-transporting material having a structure represented by the above formula (C-38), a charge-transporting material having a structure represented by the above formula (C-48) and a charge-transporting material having a structure represented by the above formula (C-55), respectively. Evaluation was made in the same way.

EXAMPLE 21

An electrophotographic photosensitive member was produced in the same manner as in Example 1 except that the bisphenol monomer used therein, having a structure represented by the above formula (B-3) (all the $R^{B1}$ to $R^{B4}$ are hydroxymethyl groups) was changed for the following bisphenol oligomer. Evaluation was made in the same way.

That is, it is a bisphenol oligomer obtained by allowing a bisphenol monomer having a structure represented by the above formula (B-3) (all the $R^{B1}$ to $R^{B4}$ are hydrogen atoms) to react with formaldehyde under alkali conditions, and is a bisphenol oligomer having a structure in which the bisphenol monomer has been condensed through a methylene group and having at least two (six on the average) hydroxymethyl groups. It is varnish-like.

EXAMPLE 22 to 25

Electrophotographic photosensitive members were produced in the same manner as in Example 21 except that the bisphenol monomer used therein, having a structure represented by the above formula (B-3) (all the $R^{B1}$ to $R^{B4}$ are hydrogen atoms) was changed for a bisphenol monomer having a structure represented by the above formula (B-14) (all the $R^{B1}$ to $R^{B4}$ are hydrogen atoms), a bisphenol monomer having a structure represented by the above formula (B-26) (all the $R^{B1}$ to $R^{B4}$ are hydrogen atoms), a bisphenol monomer having a structure represented by the above formula (B-28) (all the $R^{B1}$ to $R^{B4}$ are hydrogen atoms) and a bisphenol monomer having a structure represented by the above formula (B-34) (all the $R^{B1}$ to $R^{B4}$ are hydrogen atoms), respectively. Evaluation was made in the same way.

EXAMPLE 26

An electrophotographic photosensitive member was produced in the same manner as in Example 4 except that the surface layer formed therein was provided in a layer thickness changed to 1 μm. Evaluation was made in the same way.

EXAMPLE 27

An electrophotographic photosensitive member was produced in the same manner as in Example 4 except that the surface layer formed therein was provided in a layer thickness changed to 6 μm. Evaluation was made in the same way.

EXAMPLE 28

An electrophotographic photosensitive member was produced in the same manner as in Example 21 except that the surface layer formed therein was provided under the following conditions. Evaluation was made in the same way.

That is, in Example 21, the bisphenol monomer having a structure represented by the above formula (B-3) (all the $R^{B1}$ to $R^{B4}$ are hydrogen atoms) was changed for a bisphenol monomer having a structure represented by the above formula (B-51) (all the $R^{B2}$ to $R^{B4}$ are hydrogen atoms), the charge-transporting material having a structure represented by the above formula (C-12) was changed for a charge-transporting material having a structure represented by the following formula:

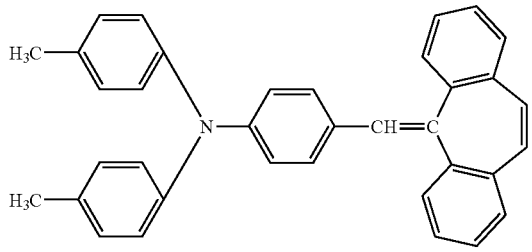

and as the solvent the ethyl alcohol was changed for methyl ethyl ketone.

EXAMPLE 29

An intermediate layer and a charge generation layer were provided on a support in the same manner as in Example 1.

Next, 10 parts of a bisphenol monomer having a structure represented by the above formula (B-26) (all the $R^{B1}$ to $R^{B4}$ are hydroxymethyl groups) and 7 parts of a charge-transporting material having a structure represented by the above formula (C-12) were dissolved in 40 parts of methyl ethyl ketone (a solvent) to prepare a surface layer (charge transport layer) coating solution, which was then dip-coated on the above charge transport layer, followed by hot-air drying at 155° C. for 1 hour to provide a surface layer (charge transport layer) with a layer thickness of 17 μm. The electrophotographic photosensitive member thus obtained was evaluated in the same way.

COMPARATIVE EXAMPLE 1

An electrophotographic photosensitive member was produced in the same manner as in Example 1 except that the surface layer formed therein was not provided. Evaluation was made in the same way.

COMPARATIVE EXAMPLE 2

An electrophotographic photosensitive member was produced in the same manner as in Example 8 except that the bisphenol monomer used therein, having a structure represented by the above formula (B-35) (all the $R^{B1}$ to $R^{B4}$ are hydroxymethyl groups) was changed for a bisphenol monomer having a structure represented by the above formula (B-50) (both the $R^{B2}$ and $R^{B3}$ are hydrogen atoms). Evaluation was made in the same way.

COMPARATIVE EXAMPLE 3

An electrophotographic photosensitive member was produced in the same manner as in Example 1 except that the surface layer formed therein was provided in the following way. Evaluation was made in the same way.

That is, 5 parts of a solution (solid content: 67% by weight) of a modified product of biuret having a structure represented by the following formula:

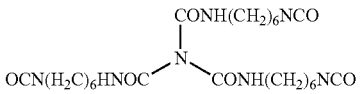

and 7.44 parts of a charge-transporting material having a structure represented by the above formula (C-50) were dissolved in 50 parts of methyl ethyl ketone to prepare a surface layer coating solution, which was then coated on the charge transport layer by spray coating, followed by drying at normal temperature for 5 hours and thereafter hot-air drying at 155° C. for 60 minutes to form a surface layer with a layer thickness of 3 μm. Here, the surface layer coating solution was so prepared as to be in a mixing ratio, (the total number of moles of hydroxyl groups of the charge-transporting material having a structure represented by the above formula (C-50)):(the total number of moles of isocyanate groups of the above formula), of 47:53.

COMPARATIVE EXAMPLE 4

An electrophotographic photosensitive member was produced in the same manner as in Example 27 except that the surface layer formed therein was not incorporated with the charge-transporting material having a structure represented by the above formula (C-12). Evaluation was made in the same way.

The results of evaluation in Examples 1 to 29 and Comparative Examples 1 to 4 are shown in Table 1.

TABLE 1

| | | Sensitivity (μJ/cm²) | Residual Potential (−V) | Depth of Wear (μm) | Image Evaluation | Coating Solution |
|---|---|---|---|---|---|---|
| Example | 1 | 0.42 | 60 | 0.30 | Good | Stable |
| | 2 | 0.48 | 98 | 0.30 | Good | Stable |
| | 3 | 0.36 | 44 | 0.32 | Good | Stable |
| | 4 | 0.32 | 30 | 0.33 | Good | Stable |
| | 5 | 0.34 | 35 | 0.31 | Good | Stable |
| | 6 | 0.34 | 36 | 0.30 | Good | Stable |
| | 7 | 0.41 | 39 | 0.30 | Good | Stable |
| | 8 | 0.41 | 39 | 0.30 | Good | Stable |
| | 9 | 0.40 | 48 | 0.51 | Good | Stable |
| | 10 | 0.59 | 55 | 0.29 | Good | Stable |
| | 11 | 0.64 | 88 | 0.31 | Good | Stable |
| | 12 | 0.30 | 30 | 0.43 | Good | Stable |
| | 13 | 0.34 | 37 | 0.30 | Good | Stable |
| | 14 | 0.30 | 31 | 0.46 | Good | Stable |
| | 15 | 0.31 | 31 | 0.40 | Good | Stable |
| | 16 | 0.29 | 29 | 0.35 | Good | Stable |
| | 17 | 0.37 | 36 | 0.29 | Good | Stable |
| | 18 | 0.35 | 30 | 0.30 | Good | Stable |
| | 19 | 0.36 | 38 | 0.33 | Good | Stable |
| | 20 | 0.31 | 32 | 0.24 | Good | Stable |
| | 21 | 0.39 | 65 | 0.44 | Good | Stable |
| | 22 | 0.29 | 34 | 0.35 | Good | Stable |
| | 23 | 0.29 | 33 | 0.32 | Good | Stable |
| | 24 | 0.30 | 32 | 0.32 | Good | Stable |
| | 25 | 0.29 | 29 | 0.22 | Good | Stable |
| | 26 | 0.27 | 27 | 0.32 | Good | Stable |
| | 27 | 0.40 | 43 | 0.30 | Good | Stable |
| | 28 | 0.41 | 48 | 0.55 | Good | Slightly Whitened |
| | 29 | 0.55 | 82 | 0.36 | Good | Stable |
| Comparative example | 1 | 0.25 | 15 | 10.2 | Fog | — |
| | 2 | 0.29 | 23 | 12.1 | Blurred Images, Fog | Stable |
| | 3 | 0.51 | 69 | 3.01 | Blurred Images | Gelled |
| | 4 | Not Measurable | 350 | 0.22 | Density Decrease | Stable |

In Table 1, the measured values of sensitivity and residual potential, the depth of wear of the surface layer after the 10,000-sheet running test, the image quality of printed images after the running test and the stability of the surface layer coating solution are shown for each Example and Comparative Example.

EXAMPLE 30

On an aluminum cylinder (JIS A 3003 aluminum alloy) as a support, having a length of 260.5 mm and a diameter of 30 mm, a 5% by weight methanol solution of a polyamide resin (trade name: AMILAN CM8000; available from Toray Industries, Inc.) was coated by dip coating, followed by drying to form an intermediate layer with a layer thickness of 0.5 μm.

Next, as a charge-generating material, 3 parts of hydroxygallium phthalocyanine of a crystal form having the strongest peak at a Bragg's angle (2θ±0.2°) of 28.1° in the CuKα characteristic X-ray diffraction and 2 parts of polyvinyl butyral resin (trade name: S-LEC BX-1; available from Sekisui Chemical Co., Ltd.) were added to 100 parts of cyclohexanone, and these were subjected to dispersion for 1 hour by means of a sand mill making use of glass beads of 1 mm in diameter, followed by addition of 100 parts of methyl ethyl ketone to make dilution to prepare a charge generation layer coating dispersion. This charge generation layer coating dispersion was dip-coated on the above intermediate layer, followed by drying at 90° C. for 10 minutes to form a charge generation layer with a layer thickness of 0.16 μm.

Next, 7.5 parts of a charge-transporting material having a structure represented by the following formula:

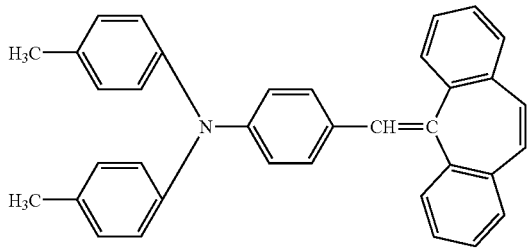

and as a binder resin 10 parts of bisphenol-Z polycarbonate (trade name: IUPILON Z-200; available from Mitsubishi Gas Chemical Company, Inc.) were dissolved in a mixed solvent of 60 parts of monochlorobenzene and 20 parts of dichloromethane to prepare a charge transport layer coating solution. This charge transport layer coating solution was dip-coated on the above charge generation layer, followed by hot-air drying at 110° C. for 1 hour to form a charge transport layer with a layer thickness of 20 μm.

Next, 10 parts of a trisphenol monomer having a structure represented by the above formula (T-2) (all the $R^{T1}$ to $R^{T6}$ are hydroxymethyl groups) and 7 parts of a charge-transporting material having a structure represented by the above formula (C-12) were dissolved in 40 parts of ethyl alcohol (a solvent) to prepare a surface layer coating solution, which was then dip-coated on the above charge transport layer, followed by hot-air drying at 155° C. for 1 hour to provide a layer (surface layer) with a layer thickness of 3 μm. The layer thickness was measured with an interference layer thickness meter (manufactured by Ohtsuka Denshi K.K.). This surface layer coating solution had so good stability that any great change in liquid properties was not particularly seen even when the coating solution was circulated for 24 hours in an environment of temperature 23° C./humidity 50% RH.

Electrophotographic performance of the electrophotographic photosensitive member thus obtained was evaluated by fitting it to a remodeled machine of a laser beam printer (trade name: LBP-NX; manufactured by CANON INC.; employing a contact charging method making use of a charging roller; using as an applied voltage a voltage formed by superimposing an AC voltage on a DC voltage), having the construction shown in FIG. 2. Its charging was so set that the dark-area potential came to −700 V, and the amount of light that was necessary when this photosensitive member was irradiated with laser light of 780 nm in wavelength to lower the potential of −700 V to −200 V was measured to regard it as sensitivity. The potential when the photosensitive member was irradiated with light in an amount of 20 $\mu J/cm^2$ was also measured as residual potential Vr. The depth of wear was still also measured which was as a result of a 10,000-sheet running test made using the like laser beam printer.

EXAMPLE 31

An electrophotographic photosensitive member was produced in the same manner as in Example 30 except that the charge generation layer formed therein was provided in the following way. Evaluation was made in the same way.

That is, as a charge-generating material, 4 parts of oxytitanium phthalocyanine of a crystal form having strong peaks at Bragg's angles (2θ±0.2°) of 9.5° and 27.1° in the CuKα characteristic X-ray diffraction and 2 parts of polyvinyl butyral resin (trade name: S-LEC BX-1; available from Sekisui Chemical Co., Ltd.) were added to 110 parts of cyclohexanone, and these were subjected to dispersion for 4.5 hours by means of a sand mill making use of glass beads of 1 mm in diameter, followed by addition of 130 parts of ethyl acetate to make dilution to prepare a charge generation layer coating dispersion. This charge generation layer coating dispersion was dip-coated on the intermediate layer, followed by drying at 90° C. for 10 minutes to form a charge generation layer with a layer thickness of 0.18 μm.

EXAMPLE 32

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-11) (all the $R^{T1}$ to $R^{T6}$ are hydroxymethyl groups). Evaluation was made in the same way.

EXAMPLE 33

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-12) (all the $R^{T2}$, $R^{T4}$ and $R^{T6}$ are hydroxymethyl groups). Evaluation was made in the same way.

EXAMPLE 34

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-13) (all the $R^{T1}$ to $R^{T6}$ are hydroxymethyl groups). Evaluation was made in the same way.

EXAMPLE 35

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-16) (all the $R^{T1}$ to $R^{T6}$ are hydroxymethyl groups). Evaluation was made in the same way.

EXAMPLE 36

An electrophotographic photosensitive member was produced in the same manner as in Example 30 except that the trisphenol monomer used therein, having a structure represented by the above formula (T-2) (all the $R^{T2}$, $R^{T4}$ and $R^{T6}$ are hydroxymethyl groups) was changed for a trisphenol monomer having a structure represented by the above formula (T-17) (all the $R^{T2}$, $R^{T4}$ and $R^{T6}$ are hydroxymethyl groups). Evaluation was made in the same way.

EXAMPLE 37

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-18) (all the $R^{T2}$, $R^{T4}$ and $R^{T6}$ are hydroxymethyl groups). Evaluation was made in the same way.

EXAMPLE 38

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-19) (all the $R^{T2}$, $R^{T4}$ and $R^{T6}$ are hydroxymethyl groups). Evaluation was made in the same way.

EXAMPLE 39

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-25) (all the $R^{T1}$ to $R^{T6}$ are hydroxymethyl groups). Evaluation was made in the same way.

EXAMPLE 40

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for a trisphenol monomer having a structure represented by the above formula (T-23) (all the $R^{T2}$, $R^{T4}$ and $R^{T6}$ are hydroxymethyl groups). Evaluation was made in the same way.

EXAMPLES 41 to 49

Electrophotographic photosensitive members were produced in the same manner as in Example 35 except that the charge-transporting material used therein, having a structure represented by the above formula (C-12) was changed for a charge-transporting material having a structure represented by the above formula (C-4), a charge-transporting material having a structure represented by the above formula (C-14), a charge-transporting material having a structure represented by the above formula (C-17), a charge-transporting material having a structure represented by the above formula (C-30), a charge-transporting material having a structure represented by the above formula (C-31), a charge-transporting material having a structure represented by the above formula (C-35), a charge-transporting material having a structure represented by the above formula (C-38), a charge-transporting material having a structure represented by the above formula (C-48) and a charge-transporting material having a structure represented by the above formula (C-55), respectively. Evaluation was made in the same way.

EXAMPLE 50

An electrophotographic photosensitive member was produced in the same manner as in Example 30 except that the trisphenol monomer used therein, having a structure represented by the above formula (T-2) (all the $R^{T1}$ to $R^{T6}$ are hydroxymethyl groups) was changed for the following trisphenol oligomer. Evaluation was made in the same way.

That is, it is a trisphenol oligomer obtained by allowing a trisphenol monomer having a structure represented by the above formula (T-2) (all the $R^{T1}$ to $R^{T6}$ are hydrogen atoms) to react with formaldehyde under alkali conditions, and is a trisphenol oligomer having a structure in which the trisphenol monomer has been condensed through a methylene group and having at least two (eight on the average) hydroxymethyl groups. It is varnish-like.

EXAMPLE 51 to 54

Electrophotographic photosensitive members were produced in the same manner as in Example 50 except that the trisphenol monomer used therein, having a structure represented by the above formula (T-2) (all the $R^{T1}$ to $R^{T6}$ are hydrogen atoms) was changed for a trisphenol monomer having a structure represented by the above formula (T-11) (all the $R^{T1}$ to $R^{T6}$ are hydrogen atoms), a trisphenol monomer having a structure represented by the above formula (T-13) (all the $R^{T1}$ to $R^{T6}$ are hydrogen atoms), a trisphenol monomer having a structure represented by the above formula (T-16) (all the $R^{T1}$ to $R^{T6}$ are hydrogen atoms) and a trisphenol monomer having a structure represented by the above formula (T-19) (all the $R^{T2}$, $R^{T4}$ and $R^{T6}$ are hydrogen atoms), respectively. Evaluation was made in the same way.

EXAMPLE 55

An electrophotographic photosensitive member was produced in the same manner as in Example 35 except that the surface layer formed therein was provided in a layer thickness changed to 1 μm. Evaluation was made in the same way.

EXAMPLE 56

An electrophotographic photosensitive member was produced in the same manner as in Example 35 except that the surface layer formed therein was provided in a layer thickness changed to 6 μm. Evaluation was made in the same way.

EXAMPLE 57

An electrophotographic photosensitive member was produced in the same manner as in Example 54 except that the surface layer formed therein was provided under the following conditions. Evaluation was made in the same way.

That is, in Example 54, the charge-transporting material having a structure represented by the above formula (C-12) was changed for a charge-transporting material having a structure represented by the following formula:

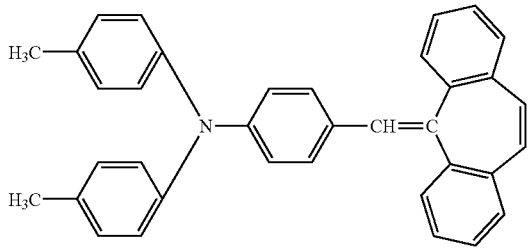

and as the solvent the ethyl alcohol was changed for methyl ethyl ketone.

EXAMPLE 58

On an aluminum cylinder (JIS A 3003 aluminum alloy) as a support, having a length of 260.5 mm and a diameter of 30 mm, a 5% by weight methanol solution of a polyamide resin (trade name: AMILAN CM8000; available from Toray Industries, Inc.) was coated by dip coating, followed by drying to form an intermediate layer with a layer thickness of 0.5 μm.

Next, as a charge-generating material, 3 parts of hydroxygallium phthalocyanine of a crystal form having the strongest peak at a Bragg's angle (2θ±0.2°) of 28.1° in the CuKα characteristic X-ray diffraction and 2 parts of polyvinyl butyral resin (trade name: S-LEC BX-1; available from Sekisui Chemical Co., Ltd.) were added to 100 parts of cyclohexanone, and these were subjected to dispersion for 1 hour by means of a sand mill making use of glass beads of 1 mm in diameter, followed by addition of 100 parts of methyl ethyl ketone to make dilution to prepare a charge generation layer coating dispersion. This charge generation layer coating dispersion was dip-coated on the above intermediate layer, followed by drying at 90° C. for 10 minutes to form a charge generation layer with a layer thickness of 0.17 μm.

Next, 10 parts of a trisphenol monomer having a structure represented by the above formula (T-16) (all the $R^{T1}$ to $R^{T6}$ are hydroxymethyl groups) and 7 parts of a charge-transporting material having a structure represented by the above formula (C-12) were dissolved in 40 parts of methyl ethyl ketone (a solvent) to prepare a surface layer (charge generation layer) coating solution, which was then dip-coated on the above charge transport layer, followed by hot-air drying at 155° C. for 1 hour to provide a surface layer (charge transport layer) with a layer thickness of 17 μm. The electrophotographic photosensitive member thus obtained was evaluated in the same way.

COMPARATIVE EXAMPLE 5

An electrophotographic photosensitive member was produced in the same manner as in Example 30 except that the surface layer formed therein was not provided. Evaluation was made in the same way.

COMPARATIVE EXAMPLE 6

An electrophotographic photosensitive member was produced in the same manner as in Example 37 except that the trisphenol monomer used therein, having a structure represented by the above formula (T-19) (all the $R^{T2}$, $R^{T4}$ and $R^{T6}$ are hydroxymethyl groups) was changed for a trisphenol monomer having a structure represented by the above formula (T-19) (all the $R^{T2}$, $R^{T4}$ and $R^{T6}$ are hydrogen atoms). Evaluation was made in the same way.

COMPARATIVE EXAMPLE 7

An electrophotographic photosensitive member was produced in the same manner as in Example 30 except that the surface layer formed therein was provided in the following way. Evaluation was made in the same way.

That is, 5 parts of a solution (solid content: 67% by weight) of a modified product of biuret having a structure represented by the following formula:

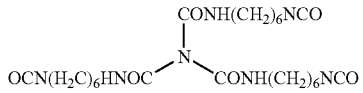

and 6.87 parts of a charge-transporting material having a structure represented by the above formula (C-50) were dissolved in 50 parts of methyl ethyl ketone to prepare a surface layer coating solution, which was then coated on the charge transport layer by spray coating, followed by drying at normal temperature for 5 hours and thereafter hot-air drying at 155° C. for 60 minutes to form a surface layer with a layer thickness of 3 μm. Here, the surface layer coating solution was so prepared as to be in a mixing ratio, (the total number of moles of hydroxyl groups of the charge-transporting material having a structure represented by the above formula (C-50)):(the total number of moles of isocyanate groups of the above formula), of 45:55.

COMPARATIVE EXAMPLE 8

An electrophotographic photosensitive member was produced in the same manner as in Example 56 except that the surface layer formed therein was not incorporated with the charge-transporting material having a structure represented by the above formula (C-12). Evaluation was made in the same way.

The results of evaluation in Examples 30 to 58 and Comparative Examples 5 to 8 are shown in Table 2.

TABLE 2

| | | Sensitivity (μJ/cm²) | Residual Potential (−V) | Depth of Wear (μm) | Image Evaluation | Coating Solution |
|---|---|---|---|---|---|---|
| Example | 30 | 0.41 | 61 | 0.81 | Good | Stable |
| | 31 | 0.45 | 95 | 0.81 | Good | Stable |
| | 32 | 0.35 | 40 | 0.35 | Good | Stable |
| | 33 | 0.32 | 35 | 0.46 | Good | Stable |
| | 34 | 0.36 | 40 | 0.30 | Good | Stable |
| | 35 | 0.35 | 38 | 0.32 | Good | Stable |
| | 36 | 0.30 | 32 | 0.41 | Good | Stable |
| | 37 | 0.32 | 35 | 0.45 | Good | Stable |
| | 38 | 0.38 | 40 | 0.33 | Good | Stable |
| | 39 | 0.45 | 90 | 0.34 | Good | Stable |
| | 40 | 0.41 | 70 | 0.35 | Good | Stable |
| | 41 | 0.30 | 31 | 0.47 | Good | Stable |
| | 42 | 0.34 | 37 | 0.40 | Good | Stable |
| | 43 | 0.31 | 32 | 0.46 | Good | Stable |
| | 44 | 0.29 | 29 | 0.39 | Good | Stable |
| | 45 | 0.28 | 28 | 0.39 | Good | Stable |
| | 46 | 0.38 | 35 | 0.28 | Good | Stable |
| | 47 | 0.36 | 34 | 0.27 | Good | Stable |
| | 48 | 0.38 | 36 | 0.31 | Good | Stable |

TABLE 2-continued

| | | Sensitivity ($\mu J/cm^2$) | Residual Potential (−V) | Depth of Wear (μm) | Image Evaluation | Coating Solution |
|---|---|---|---|---|---|---|
| | 49 | 0.31 | 32 | 0.26 | Good | Stable |
| | 50 | 0.40 | 66 | 0.80 | Good | Stable |
| | 51 | 0.30 | 35 | 0.32 | Good | Stable |
| | 52 | 0.30 | 34 | 0.29 | Good | Stable |
| | 53 | 0.31 | 32 | 0.29 | Good | Stable |
| | 54 | 0.28 | 30 | 0.66 | Good | Stable |
| | 55 | 0.26 | 28 | 0.46 | Good | Stable |
| | 56 | 0.39 | 44 | 0.44 | Good | Stable |
| | 57 | 0.41 | 48 | 0.71 | Good | Slightly Whitened |
| | 58 | 0.52 | 85 | 0.48 | Good | Stable |
| Comparative Example | 5 | 0.25 | 15 | 10.2 | Fog | — |
| | 6 | 0.29 | 23 | 12.1 | Blurred Images, Fog | Stable |
| | 7 | 0.51 | 69 | 3.01 | Blurred Images | Gelled |
| | 8 | Not Measurable | 340 | 0.30 | Density Decrease | Stable |

In Table 2, the measured values of sensitivity and residual potential, the depth of wear of the surface layer after the 10,000-sheet running test, the image quality of printed images after the running test and the stability of the surface layer coating solution are shown for each Example and Comparative Example.

EXAMPLE 59

On an aluminum cylinder (JIS A 3003 aluminum alloy) as a support, having a length of 260.5 mm and a diameter of 30 mm, a 5% by weight methanol solution of a polyamide resin (trade name: AMILAN CM8000; available from Toray Industries, Inc.) was coated by dip coating, followed by drying to form an intermediate layer with a layer thickness of 0.5 μm.

Next, as a charge-generating material, 13 parts of oxytitanium phthalocyanine of a crystal form having strong peaks at Bragg's angles (2θ±0.2°) of 9.0°, 14.2°, 23.9° and 27.1° in the CuKα characteristic X-ray diffraction and 10 parts of polyvinyl butyral resin (trade name: S-LEC BX-1; available from Sekisui Chemical Co., Ltd.) were added to 250 parts of cyclohexanone, and these were subjected to dispersion for 1 hour by means of a sand mill making use of glass beads of 1 mm in diameter, followed by addition of 50 parts of ethyl acetate to make dilution to prepare a charge generation layer coating dispersion. This charge generation layer coating dispersion was dip-coated on the above intermediate layer, followed by drying at 80° C. for 10 minutes to form a charge generation layer with a layer thickness of 0.25 μm.

Next, 10 parts of a charge-transporting material having a structure represented by the following formula:

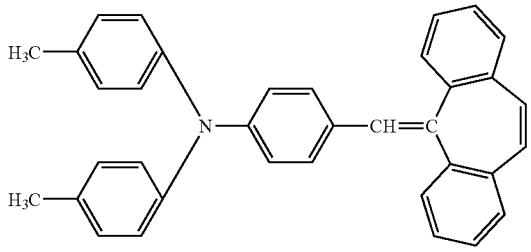

and as a binder resin 10 parts of bisphenol-Z polycarbonate (trade name: IUPILON Z-200; available from Mitsubishi Gas Chemical Company, Inc.) were dissolved in a mixed solvent of 40 parts of monochlorobenzene and 20 parts of dichloromehtane to prepare a charge transport layer coating solution. This charge transport layer coating solution was dip-coated on the above charge generation layer, followed by hot-air drying at 100° C. for 80 minutes to form a charge transport layer with a layer thickness of 20 μm.

Next, 50 parts of antimony-doped tin oxide particles (trade name: T-1; available from Mitsubishi Material K.K.) surface-treated with a methylhydroxysiloxane compound (trade name: KF-99; available from Shin-Etsu Chemical Co., Ltd.) (amount of treatment: 8%) and 150 parts of ethanol were subjected to dispersion by means of a sand mill over a period of 66 hours. Thereafter, 23 parts of a bisphenol monomer having a structure represented by the above formula (B-3) (all the $R^{B1}$ to $R^{B4}$ are hydroxymethyl groups) was dissolved therein to prepare a surface layer coating dispersion, which was then dip-coated on the above charge transport layer, followed by hot-air drying at 145° C. for 1 hour to provide a layer (surface layer) with a layer thickness of 3 μm. The layer thickness was measured with an interference layer thickness meter (manufactured by Ohtsuka Denshi K.K.). The electrophotographic photosensitive member thus obtained was evaluated in the same way.

EXAMPLE 60

An electrophotographic photosensitive member was produced in the same manner as in Example 59 except that the surface layer coating dispersion used therein was prepared in the following way. Evaluation was made in the same way.

That is, 20 parts of antimony-doped tin oxide particles (trade name: T-1; available from Mitsubishi Material K.K.) surface-treated with (3,3,3-tifluoropropyl)trimethoxysilane (available from Shin-Etsu Chemical Co., Ltd.) (amount of treatment: 7%), 30 parts of antimony-doped tin oxide particles (trade name: T-1; available from Mitsubishi Material K.K.) surface-treated with a methylhydroxysiloxane compound (trade name: KF-99; available from Shin-Etsu Chemical Co., Ltd.) (amount of treatment: 8%) and 150 parts of ethanol were subjected to dispersion by means of a sand mill over a period of 66 hours, followed by addition of 20 parts of polytetrafluoroethylene particles (average particle diameter: 0.18 μm) and then further dispersion. Thereafter, 24 parts of a bisphenol monomer having a structure represented by the above formula (B-3) (all the $R^{B1}$ to $R^{B4}$ are hydroxymethyl groups) was dissolved therein to prepare the surface layer coating dispersion.

EXAMPLES 61 to 91

Electrophotographic photosensitive members were produced in the same manner as in Example 60 except that the bisphenol monomer used therein, having a structure represented by the above formula (B-3) (all the $R^{B1}$ to $R^{B4}$ are hydroxymethyl groups) was changed for polyhydroxymethylbisphenol monomers or polyhydroxymethyltrisphenol monomers shown in Table 3. Evaluation was made in the same way.

TABLE 3

| | | Monomer Used | Mixing Ratio | $R^{B1}$–$R^{B4}$ (Bisphenol)/ $R^{T1}$–$R^{T6}$ (Trisphenol) |
|---|---|---|---|---|
| Example | 59 | B-3 | | All hydroxymethyl groups |
| | 60 | B-3 | | All hydroxymethyl groups |
| | 61 | B-58 | | Hydroxymethyl groups other than $R^{B5}$ and $R^{B6}$ |
| | 62 | B-26 | | All hydroxymethyl groups |
| | 63 | B-54 | | All hydroxymethyl groups |
| | 64 | B-56 | | All hydroxymethyl groups |
| | 65 | B-55 | | All hydroxymethyl groups |
| | 66 | B-14 | | All hydroxymethyl groups |
| | 67 | B-31 | | All hydroxymethyl groups |
| | 68 | B-19 | | All hydroxymethyl groups |
| | 69 | B17 | | All hydroxymethyl groups |
| | 70 | B-28 | | All hydroxymethyl groups |
| | 71 | B-30 | | All hydroxymethyl groups |
| | 72 | B27 | | All hydroxymethyl groups |
| | 73 | B-3/B-31 | 5:5 | All hydroxymethyl groups |
| | 74 | B-6/B-3 | 3:7 | All hydroxymethyl groups |
| | 75 | B-5 | | All hydroxymethyl groups |
| | 76 | B-3 | | Hydroxymethyl groups other than $R^{B2}$ and $R^{B4}$ |
| | 77 | B-50 | | All hydroxyniethyl groups |
| | 78 | B-28 | | Hydroxymethyl groups other than $R^{B2}$ and $R^{B4}$ |
| | 79 | B-26 | | Hydroxymethyl groups other than $R^{B2}$ and $R^{B4}$ |
| | 80 | B-54 | | Hydroxymethyl groups other than $R^{B2}$ and $R^{B4}$ |
| | 81 | B-5 | | Hydroxymethyl groups other than $R^{B2}$ and $R^{B4}$ |
| | 82 | B-6/B-3 | 3:7 | Hydroxymethyl groups other than $R^{B2}$ and $R^{B4}$ |
| | 83 | B-28/B-26 | 5:5 | Hydroxymethyl groups other than $R^{B2}$ and $R^{B4}$ |
| | 84 | T-2 | | All hydroxymethyl groups |
| | 85 | T-2 | | Hydroxymethyl groups other than $R^{B2}$, $R^{B4}$ and $R^{B6}$ |
| | 86 | T-20 | | All hydroxymethyl groups |
| | 87 | T-16 | | All hydroxymethyl groups |
| | 88 | T-1 | | Hydroxymethyl groups other than $R^{B2}$, $R^{B4}$ and $R^{B6}$ |
| | 89 | T-21 | | All hydroxymethyl groups |
| | 90 | T-11 | | All hydroxymethyl groups |
| | 91 | T-9 | | Hydroxymethyl groups other than $R^{B2}$, $R^{B4}$ and $R^{B6}$ |

COMPARATIVE EXAMPLE 9

An electrophotographic photosensitive member was produced in the same manner as in Example 59 except that the surface layer formed therein was not provided. Evaluation was made in the same way.

COMPARATIVE EXAMPLE 10

An electrophotographic photosensitive member was produced in the same manner as in Example 59 except that the antimony-doped tin oxide particles (trade name: T-1; available from Mitsubishi Material K.K.) used therein, surface-treated with a methylhydroxysiloxane compound (trade name: KF-99; available from Shin-Etsu Chemical Co., Ltd.) (amount of treatment: 8%) was not incorporated in the surface layer. Evaluation was made in the same way.

COMPARATIVE EXAMPLE 11

An electrophotographic photosensitive member was produced in the same manner as in Example 60 except that the bisphenol monomer used therein, having a structure represented by the above formula (B-3) (all the $R^{B1}$ to $R^{B4}$ are hydroxymethyl groups) was changed for a bisphenol monomer having a structure represented by the above formula (B-51) (the $R^{B2}$ and $R^{B3}$ are hydrogen atoms). Evaluation was made in the same way.

COMPARATIVE EXAMPLE 12

An electrophotographic photosensitive member was produced in the same manner as in Example 59 except that the surface layer formed therein was provided in the following way. Evaluation was made in the same way.

That is, 20 parts of antimony-doped tin oxide particles (trade name: T-1; available from Mitsubishi Material K.K.) surface-treated with (3,3,3-tifluoropropyl)trimethoxysilane (available from Shin-Etsu Chemical Co., Ltd.) (amount of treatment: 7%), 30 parts of antimony-doped tin oxide particles (trade name: T-1; available from Mitsubishi Material K.K.) surface-treated with a methylhydroxysiloxane compound (trade name: KF-99; available from Shin-Etsu Chemical Co., Ltd.) (amount of treatment: 8%) and 150 parts of ethanol were subjected to dispersion by means of a sand mill over a period of 66 hours, followed by addition of 20 parts of polytetrafluoroethylene particles (average particle diameter: 0.18 μm) and then further dispersion. Thereafter, 22 parts of acrylic resin having a structure represented by the following formula:

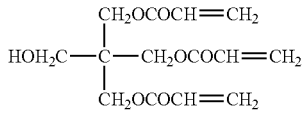

and as a photopolymerization initiator 5 parts of 2-methdylthioxanthone were added to prepare a surface layer coating dispersion, which was then dip-coated on the charge transport layer, followed by photo-curing using a high-pressure mercury lamp at a light intensity of 800 mV/cm$^2$ for 60 seconds, further followed by hot-air drying at 120° C. for 2 hours to provide a layer (surface layer) with a layer thickness of 3 μm.

Measurement of Volume Resistivity:

On polyethylene terephthalate sheets, comb type electrodes having gaps of 180 μm each were formed by vacuum deposition of gold. Then the surface layer coating dispersions used in Examples 59 to 91 and Comparative Examples 8 to 10 were coated thereon, followed by heat treatment at 145° C. for 1 hour to form films with a layer thickness of 3 μm to prepare samples. Their volume resistivity was measured by fitting each sample to PA Meter 4140B, manufactured by Hewlett-Pachard Co., and applying 100 V. Measurement was made in three environments of temperature/humidity: 23° C./50% RH, 23° C./5% RH and 30° C./80% RH.

The results of measurement of the volume resistivity are shown in Table 4.

TABLE 4

| | | Volume Resistivity | | |
|---|---|---|---|---|
| | | 23° C./50% RH | 23° C./5% RH | 30° C./80% RH |
| Example | 59 | 3.50 | 3.60 | 1.54 |
| | 60 | 4.50 | 4.51 | 1.21 |
| | 61 | 3.60 | 3.77 | 1.63 |
| | 62 | 4.22 | 4.62 | 1.63 |
| | 63 | 3.50 | 3.60 | 1.51 |
| | 64 | 4.50 | 4.51 | 1.12 |
| | 65 | 3.60 | 3.77 | 1.63 |
| | 66 | 4.22 | 4.62 | 1.63 |
| | 67 | 3.60 | 3.80 | 1.36 |
| | 68 | 4.51 | 4.69 | 1.47 |
| | 69 | 3.77 | 4.22 | 1.65 |
| | 70 | 4.62 | 4.89 | 1.89 |
| | 71 | 3.50 | 3.60 | 1.54 |
| | 72 | 4.50 | 4.51 | 1.12 |
| | 73 | 3.60 | 3.77 | 1.63 |
| | 74 | 4.22 | 4.62 | 1.63 |
| | 75 | 3.50 | 3.60 | 1.54 |
| | 76 | 4.50 | 4.51 | 1.12 |
| | 77 | 4.50 | 4.51 | 1.12 |
| | 78 | 3.60 | 3.77 | 1.63 |
| | 79 | 4.22 | 4.62 | 1.63 |
| | 80 | 3.60 | 3.80 | 1.36 |
| | 81 | 4.51 | 4.69 | 1.47 |
| | 82 | 3.50 | 3.60 | 1.54 |
| | 83 | 4.50 | 4.51 | 1.12 |
| | 84 | 3.60 | 3.77 | 1.63 |
| | 85 | 4.22 | 4.62 | 1.63 |
| | 86 | 3.50 | 3.60 | 1.54 |
| | 87 | 4.50 | 4.51 | 1.12 |
| | 88 | 3.60 | 3.77 | 1.63 |
| | 89 | 3.60 | 3.77 | 1.63 |
| | 90 | 4.22 | 4.62 | 1.63 |
| | 91 | 4.50 | 4.51 | 1.12 |
| Comparative Example | 9 | | — | |
| | 10 | ≧480 | ≧480 | ≧480 |
| | 11 | 4.80 | 4.90 | 1.90 |
| | 12 | 5.02 | 11.0 | 0.0101 |

3,000-Sheet Running Test:

Next, the electrophotographic photosensitive members produced in Examples 59 to 91 and Comparative Examples 8 to 10 were each fitted to a remodeled machine of a laser beam printer (trade name: LBP-NX; manufactured by CANON INC.; employing a contact charging method making use of a charging roller; using as an applied voltage a voltage formed by superimposing an AC voltage on a DC voltage), having the construction shown in FIG. 2. A 3,000-sheet running test was conducted in an environment of temperature 23° C. and humidity 50% RH.

As evaluation items in the running test, the depth of wear of the surface of each electrophotographic photosensitive member as a result of 3,000-sheet running was measured, the image quality of images again reproduced using the above laser beam printer after each electrophotographic photosensitive member was left in an environment of temperature 30° C. and humidity 80% RH for 24 hours was examined, and the residual potential before the running test using the laser beam printer was measured. The residual potential was measured in an environment of temperature 23° C. and humidity 50% RH, where the surface of each electrophotographic photosensitive member was charged to −700 V using a drum test machine manufactured by Gentec K.K., and the surface potential after 0.2 second after strong exposure was regarded as the residual potential.

The results of the 3,000-sheet running test are shown in Table 5.

TABLE 5

| | | Depth of Wear (μm) | Image Evaluation | Residual Potential (-V) |
|---|---|---|---|---|
| Example | 59 | 0.25 | Good | 35 |
| | 60 | 0.11 | Good | 40 |
| | 61 | 0.15 | Good | 38 |
| | 62 | 0.12 | Good | 42 |
| | 63 | 0.17 | Good | 45 |
| | 64 | 0.22 | Good | 41 |
| | 65 | 0.17 | Good | 43 |
| | 66 | 0.12 | Good | 44 |
| | 67 | 0.15 | Good | 40 |
| | 68 | 0.20 | Good | 40 |
| | 69 | 0.17 | Good | 42 |
| | 70 | 0.18 | Good | 38 |
| | 71 | 0.11 | Good | 39 |
| | 72 | 0.17 | Good | 45 |
| | 73 | 0.22 | Good | 41 |
| | 74 | 0.17 | Good | 43 |
| | 75 | 0.12 | Good | 44 |
| | 76 | 0.15 | Good | 40 |
| | 77 | 0.20 | Good | 40 |
| | 78 | 0.11 | Good | 40 |
| | 79 | 0.15 | Good | 38 |
| | 80 | 0.12 | Good | 42 |
| | 81 | 0.17 | Good | 45 |
| | 82 | 0.22 | Good | 41 |
| | 83 | 0.17 | Good | 43 |
| | 84 | 0.12 | Good | 44 |
| | 85 | 0.15 | Good | 40 |
| | 86 | 0.20 | Good | 40 |
| | 87 | 0.17 | Good | 42 |
| | 88 | 0.18 | Good | 38 |
| | 89 | 0.11 | Good | 39 |
| | 90 | 0.17 | Good | 45 |
| | 91 | 0.22 | Good | 41 |
| Comparative Example | 9 | 3.16 | Good | 20 |
| | 10 | 0.15 | Density Decrease | 251 |
| | 11 | 4.21 | Good | 42 |
| | 12 | 0.31 | Blurred Images | 35 |

As shown in Tables 4 and 5, in Examples 59 to 91 according to the present invention, the surface layers of the electrophotographic photosensitive members have electrical resistance (volume resistivity) showing superior environmental stability, have low residual potential even in the low-humidity environment in which the residual potential may most severely rise, and also do not cause any blurred images or smeared images in the high-humidity environment. They can also retain the film strength of tough surface layers, show only a small depth of wear caused by running, and can form high-grade images in a high stability and a high running performance.

According to the present invention, it can provide the electrophotographic photosensitive member having a cure type surface layer which has a superior wear resistance and has a hardness high enough not to cause any scratches, without adding any curing catalyst, and besides does not cause any deterioration of the charge transport performance the electrophotographic photosensitive member has originally.

According to the present invention, it can also provide the electrophotographic photosensitive member having a surface layer which can be formed by coating in a high productivity.

According to the present invention, it can still also provide the process cartridge and the electrophotographic apparatus which have the above electrophotographic photosensitive member.

What is claimed is:

1. An electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing (2)

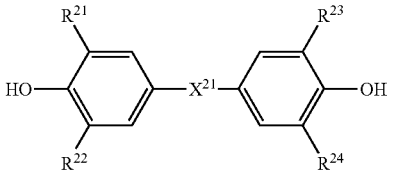

wherein $X^{21}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{21}$ to $R^{24}$ each independently represent a hydrogen atom, a halogen atom, a substituted or unsubstituted alkyl group having 1 to 4 carbon atoms, a substituted or unsubstituted cycloalkyl group having 3 to 6 carbon atoms, or a substituted or unsubstituted alkoxyl group having 1 to 4 carbon atoms.

2. An electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing a polyhydroxymethylbisphenol monomer having a structure represented by the following Formula (1):

(1)

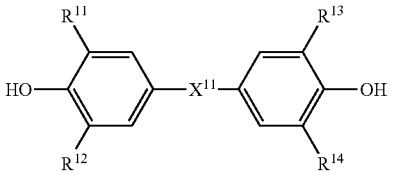

wherein $X^{11}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group.

3. The electrophotographic photosensitive member according to claim 2, wherein the $X^{11}$ in Formula (1) is a divalent group having 3 or more carbon atoms.

4. The electrophotographic photosensitive member according to claim 3, wherein the $X^{11}$ in Formula (1) is a divalent group having 5 or more carbon atoms and having a cyclic structure.

5. The electrophotographic photosensitive member according to claim 2, wherein the $X^{11}$ in Formula (1) is a divalent group having a benzene ring.

6. The electrophotographic photosensitive member according to claim 2, wherein the $X^{11}$ in Formula (1) is an ether group, a thioether group or a di(trifluoromethyl)methylene group.

7. An electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing a polyhydroxymethylbisphenol oligomer having a structure in which a bisphenol monomer having a structure represented by the following Formula (2) has been condensed through a methylene group:

(2)

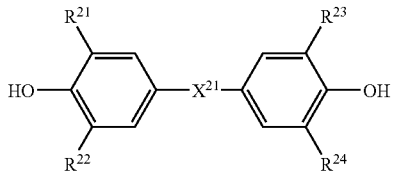

wherein $X^{21}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{21}$ to $R^{24}$ each independently represent a hydrogen atom, a halogen atom, a substituted or unsubstituted alkyl group having 1 to 4 carbon atoms, a substituted or unsubstituted cycloalkyl group having 3 to 6 carbon atoms, or a substituted or unsubstituted alkoxyl group having 1 to 4 carbon atoms.

8. The electrophotographic photosensitive member according to claim 7, wherein the $X^{21}$ in Formula (2) is a divalent group having 3 or more carbon atoms.

9. The electrophotographic photosensitive member according to claim 8, wherein the $X^{21}$ in Formula (2) is a divalent group having 5 or more carbon atoms and having a cyclic structure.

10. The electrophotographic photosensitive member according to claim 7, wherein the $X^{21}$ in Formula (2) is a divalent group having a benzene ring.

11. The electrophotographic photosensitive member according to claim 7, wherein the $X^{21}$ in Formula (2) is an ether group, a thioether group or a di(trifluoromethyl) methylene group.

12. A process cartridge comprising an electrophotographic photosensitive member and at least one means selected from the group consisting of a charging means, a developing means, a transfer means and a cleaning means which are integrally supported, and being detachably mountable to the main body of an electrophotographic apparatus; the electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing (i) a polyhydroxymethylbisphenol monomer having a structure represented by the following Formula (1):

(1)

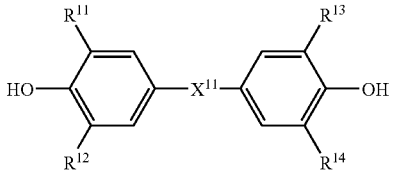

wherein $X^{11}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group or (ii) a polyhydroxymethylbisphenol oligomer having a structure in which a bisphenol monomer having a structure represented by the following Formula (2) has been condensed through a methylene group:

(2)

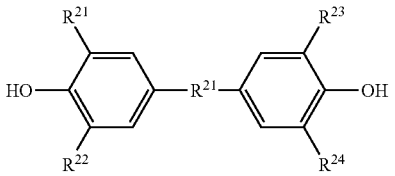

wherein $X^{21}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{21}$ to $R^{24}$ each independently represent a hydrogen atom, a halogen atom, a substituted or unsubstituted alkyl group having 1 to 4 carbon atoms a substituted or unsubstituted cycloalkyl group having 3 to 6 carbon atoms, or a substituted or unsubstituted alkoxyl group having 1 to 4 carbon atoms.

13. An electrophotographic apparatus comprising an electrophotographic photosensitive member, a charging means, an exposure means, a developing means and a transfer means; the electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing (i) a polyhydroxymethylbisphenol monomer having a structure represented by the following Formula (1):

(1)

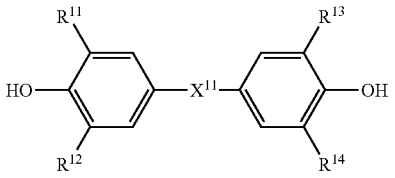

wherein $X^{11}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group or (ii) a polyhydroxymethylbisphenol oligomer having a structure in which a bisphenol monomer having a structure represented by the following Formula (2) has been condensed through a methylene group:

(2)

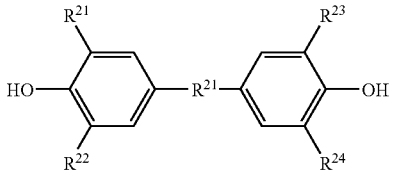

wherein $X^{21}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{21}$ to $R^{24}$ each independently represent a hydrogen atom, a halogen atom, a substituted or unsubstituted alkyl group having 1 to 4 carbon atoms, a substituted or unsubstituted cycloalkyl group having 3 to 6 carbon atoms, or a substituted or unsubstituted alkoxyl group having 1 to 4 carbon atoms.

14. A process cartridge comprising an electrophotographic photosensitive member and at least one means selected from the group consisting of a charging means, a developing means, a transfer means and a cleaning means which are integrally supported, and being detachably mountable to the main body of an electrophotographic apparatus; the electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing a polyhydroxymethylbisphenol monomer having a structure represented by the following Formula (1):

(1)

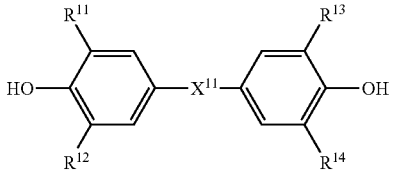

wherein $X^{11}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided hat a case in which both the $R^{01}$ and $R^{02}$ are substituted or, unsubstituted phenyl groups is excluded; and $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group.

15. An electrophotographic apparatus comprising an electrophotographic photosensitive member, a charging means, an exposure means, a developing means and a transfer means; the electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing a polyhydroxymethylbisphenol monomer having a structure represented by the following Formula (1):

(1)

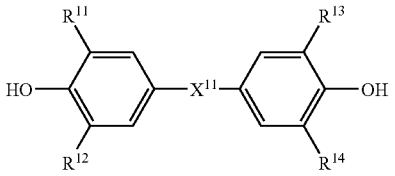

wherein $X^{11}$ represents a single bond, a carbonyl group, an ether group, a thioether group or a —$CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group.

16. A process cartridge comprising an electrophotographic photosensitive member and at least one means selected from the group consisting of a charging means, a developing means, a transfer means and a cleaning means which are integrally supported, and being detachably mountable to the main body of an electrophotographic apparatus; the electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing polyhydroxymethylbisphenol oligomer having a structure in which a bisphenol monomer having a structure represented by the following Formula (2) has been condensed through a methylene group:

(2)

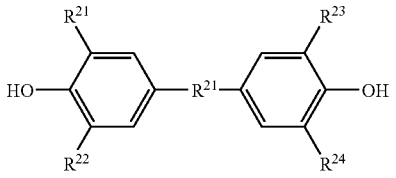

wherein $X^{21}$ represents a single bond, a carbonyl group, an ether group, a thioether group or a —$CR^{01}R^{02}$- group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{21}$ to $R^{24}$ each independently represent a hydrogen atom, a halogen atom, a substituted or unsubstituted alkyl group having 1 to 4 carbon atoms a substituted or unsubstituted cycloalkyl group having 3 to 6 carbon atoms, or a substituted or unsubstituted alkoxyl group having 1 to 4 carbon atoms.

17. An electrophotographic apparatus comprising an electrophotographic photosensitive member, a charging means, an exposure means, a developing means and a transfer means; the electrophotographic photosensitive member comprising a support and provided thereon a photosensitive layer, wherein;

said electrophotographic photosensitive member has a surface layer containing:

at least one of a charge-transporting material and conductive particles; and a polymer obtained by polymerizing a polyhydroxymethylbisphenol oligomer having a structure in which a bisphenol monomer having a structure represented by the following Formula (2) has been condensed through a methylene group:

(2)

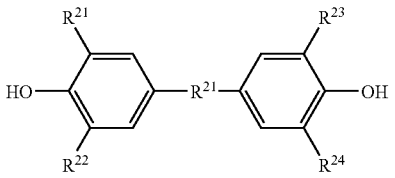

wherein $X^{21}$ represents a single bond, a carbonyl group, an ether group, a thioether group or a —$CR^{01}R^{02}$- group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{21}$ to $R^{24}$ each independently represent a hydrogen atom, a halogen atom, a substituted or unsubstituted alkyl group having 1 to 4 carbon atoms, a substituted or unsubstituted cycloalkyl group having 3 to 6 carbon atoms, or a substituted or unsubstituted alkoxyl group having 1 to 4 carbon atoms.

* * * * *

UNITED STATES PATENT AND TRADEMARK OFFICE

CERTIFICATE OF CORRECTION

PATENT NO. : 7,022,446 B2
APPLICATION NO. : 10/616944
DATED : April 4, 2006
INVENTOR(S) : Kimihiro Yoshimura et al.

It is certified that error appears in the above-identified patent and that said Letters Patent is hereby corrected as shown below:

ONTHE TITLE PAGE [73]:

Assignees, insert: --(73) Assignee: Canon Kabushiki Kaisha, Tokyo (JP)--.

ON THE TITLE PAGE [76]:

Inventors, "(76) Inventors: Kimihiro Yoshimura, Canon Kabushiki Kaisha 3-30-2, Shimiomaruko, Ohta-ku, Tokyo (JP); Yosuke Morikawa, Canon Kabushiki Kaisha 3-30-2, Shimomaruko, Ohta-ku, Tokyo (JP); Tatsuya Ikezue, Canon Kabushiki Kaisha 3-30-2, Shimomaruko, Ohta-ku, Tokyo (JP); Kouichi Nakata, Canon Kabushiki Kaisha, 3-30-2, Simomaruko, Ohta-ku, Tokyo (JP); Daisuke Tanaka, Canon Kabushiki Kaisha 3-30-2, Shimomaruko, Ohta-ku, Tokyo (JP)" should read --(75) Inventors; Kimihiro Yoshimura, Kanagawa (JP); Yosuke Morikawa, Kanagawa (JP); Tatsuya Ikezue, Kanagawa (JP); Kouichi Nakata, Shizuoka (JP); Daisuke Tanaka, Shizuoka (JP)--.

COLUMN 5:

Line 37, "ace al" should read --acetal--.

COLUMN 9:

Line 23, "virture" should read --virtue--.

COLUNN 30:

Line 11, "a" should be deleted.

COLUMN 42:

Line 25, "Specified" should read --Specific--.

UNITED STATES PATENT AND TRADEMARK OFFICE

CERTIFICATE OF CORRECTION

PATENT NO. : 7,022,446 B2
APPLICATION NO. : 10/616944
DATED : April 4, 2006
INVENTOR(S) : Kimihiro Yoshimura et al.

It is certified that error appears in the above-identified patent and that said Letters Patent is hereby corrected as shown below:

COLUMN 46:

Line 59, "dichloromehtane" should read --dichloromethane--.

COLUMN 48:

Line 46, "the $R^{B3}$" should read --the $R^{B1}$--.

COLUMN 49:

Line 57, "Example 22-25" should read --Examples 22-25--.

COLUMN 51:

Line 36, "

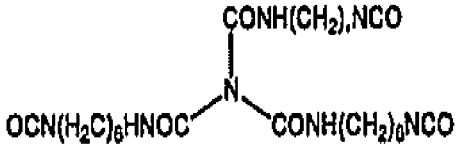

" should read

--

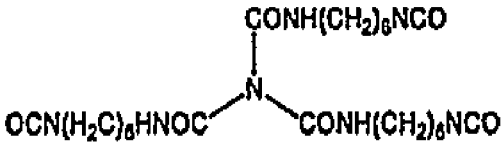

--.

COLUMN 56:

Line 23, "Example 51-54" should read --Examples 51-54--.

COLUMN 60:

Line 19, "dichloromehtane" should read --dichloromethane--; and
Line 52, "(3,3,3-tifluoropropul)" should read --(3,3,3-trifluoropropyl)--.

UNITED STATES PATENT AND TRADEMARK OFFICE

CERTIFICATE OF CORRECTION

PATENT NO. : 7,022,446 B2
APPLICATION NO. : 10/616944
DATED : April 4, 2006
INVENTOR(S) : Kimihiro Yoshimura et al.

It is certified that error appears in the above-identified patent and that said Letters Patent is hereby corrected as shown below:

COLUMN 61:

Table 3, "hydroxyniethyl" should read --hydroxymethyl--.

COLUMN 62:

Line 26, "(3,3,3-tifluoropropul)" should read --(3,3,3-trifluoropropyl)--; and
Line 48, "dylthioxanthone" should read --ylthioxanthone--.

COLUMN 65:

Line 9, "polymerizing" should read
--polymierizing (i) a polyhydroxymethylbisphenol monomer having a structure represented by the following Formula (1):

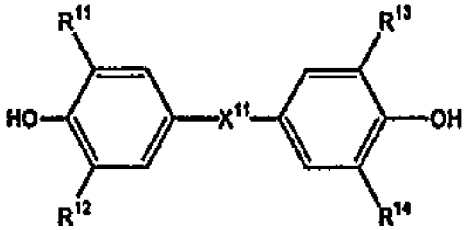

(1)

wherein $X^{11}$ represents a single bond, a carbonyl group, an ether group, a thioether group or a $-CR^{01}R^{02}$-group, where $R^{01}$ and $R^{02}$ each independently represent a hydrogen atom, a substituted or unsubstituted alkyl group having 1 to 4 carbon atoms or a substituted or unsubstituted phenyl group, or represent a substituted or unsubstituted cycloalkylidene group having 3 to 6 carbon atoms which is formed by combination of $R^{01}$ with $R^{02}$, provided that a case in which both the $R^{01}$ and $R^{02}$ are substituted or unsubstituted phenyl groups is excluded; and $R^{11}$ to $R^{14}$ each independently represent a hydroxymethyl group, a hydrogen atom, a halogen atom, a substituted or unsubstituted alkyl group having 1 to 4 carbon atoms other than the hydroxymethyl group, a substituted or unsubstituted cycloalkyl group having 3 to 6 carbon atoms, or a substituted or unsubstituted alkoxyl group having 1 to 4 carbon atoms, provided that at least two of the $R^{11}$ to $R^{14}$ are each a hydroxymethyl group or (ii) a polyhydroxymethylbisphenol monomer having a structure represented by the following Formula (2) has been condensed through a methylene group:--

UNITED STATES PATENT AND TRADEMARK OFFICE

CERTIFICATE OF CORRECTION

PATENT NO. : 7,022,446 B2
APPLICATION NO. : 10/616944
DATED : April 4, 2006
INVENTOR(S) : Kimihiro Yoshimura et al.

It is certified that error appears in the above-identified patent and that said Letters Patent is hereby corrected as shown below:

COLUMN 67:

Line 62, "(ii)" should read --¶ (ii)--.

COLUMN 68:

Line 23, "atoms" should read --atoms,--.

COLUMN 70:

Line 3, "hat" should read --that--.
Line 4, "or," should read --or--.

COLUMN 71:

Line 31, "atoms" should read --atoms,--.

Signed and Sealed this

Twenty-sixth Day of December, 2006

JON W. DUDAS
*Director of the United States Patent and Trademark Office*